US012630387B2

(12) United States Patent
Kawahigashi et al.

(10) Patent No.: US 12,630,387 B2
(45) Date of Patent: May 19, 2026

(54) INSTALLATION TOOL AND INSTALLATION METHOD

(71) Applicant: DAIFUKU CO., LTD., Osaka (JP)

(72) Inventors: Tatsuya Kawahigashi, Shiga (JP); Keisuke Ebisu, Shiga (JP)

(73) Assignee: DAIFUKU CO., LTD., Osaka (JP)

( * ) Notice: Subject to any disclaimer, the term of this patent is extended or adjusted under 35 U.S.C. 154(b) by 131 days.

(21) Appl. No.: 18/473,563

(22) Filed: Sep. 25, 2023

(65) Prior Publication Data

US 2024/0109746 A1 Apr. 4, 2024

(30) Foreign Application Priority Data

Sep. 29, 2022 (JP) ..... 2022-156698
Aug. 24, 2023 (JP) ..... 2023-136580

(51) Int. Cl.
*B65H 49/32* (2006.01)

(52) U.S. Cl.
CPC ..... *B65H 49/32* (2013.01)

(58) Field of Classification Search
CPC ..... H02G 1/04; B65H 49/32
See application file for complete search history.

(56) References Cited

U.S. PATENT DOCUMENTS 3,672,636 A * 6/1972 Parsen ..... H02G 1/04 254/134.3 R
5,524,869 A * 6/1996 Asplin ..... H02G 1/04 254/134.3 CL
2003/0042114 A1* 3/2003 Iizuka ..... B61C 13/04 198/570
2004/0107558 A1 6/2004 Forsberg et al.
2005/0098404 A1* 5/2005 Swoboda ..... B60M 1/307 191/10
2009/0065750 A1* 3/2009 Theisen ..... H02G 7/10 254/134.3 R
2014/0110449 A1* 4/2014 Kushnick ..... H02G 1/04 226/1

(Continued)

FOREIGN PATENT DOCUMENTS

JP S5663633 U 5/1981
JP S5794534 U 6/1982

(Continued)

OTHER PUBLICATIONS

Office Action dated Jan. 6, 2026 issued in Japanese patent application No. 2023-136580.

*Primary Examiner* — Kyle A Cook
(74) *Attorney, Agent, or Firm* — Harness, Dickey & Pierce, P.L.C.

(57) ABSTRACT

Work for installation of a feed line is efficiently conducted. An installation tool installs a feed line in a feed line holder, the feed line holder accompanying any of rails for allowing a carrier to travel thereon and holding the feed line, the feed line feeding electric power to the carrier in a non-contact manner. The installation tool includes: a main body part configured to be capable of moving along the rails; and a pressing part configured to move together with the main body part along the rails and continuously press the feed line into a holding part of the feed line holder as the main body part is moved, the holding part being partially open.

17 Claims, 16 Drawing Sheets

(56) References Cited

U.S. PATENT DOCUMENTS

| | | | | |
|---|---|---|---|---|
| 2015/0044009 | A1* | 2/2015 | Yang | H02G 1/04 414/800 |
| 2018/0122672 | A1* | 5/2018 | Chang | H01L 21/6776 |
| 2021/0210936 | A1 | 7/2021 | Truthseeker | |
| 2022/0063909 | A1* | 3/2022 | Yoon | H01L 21/67733 |
| 2022/0144099 | A1* | 5/2022 | Casali | B60L 5/24 |

FOREIGN PATENT DOCUMENTS

| | | | | |
|---|---|---|---|---|
| JP | 2002-337574 | A | 11/2002 | |
| JP | 2021-003946 | A | 1/2021 | |
| KR | 10-1325545 | B1 | 11/2013 | |
| KR | 101497323 | B1 * | 3/2015 | H02G 1/083 |

* cited by examiner

INSTALLATION TOOL AND INSTALLATION METHOD

This Nonprovisional application claims priority under U.S.C. § 119 on Patent Application No. 2022-156698 filed in Japan on Sep. 29, 2022 and Patent Application No. 2023-136580 filed in Japan on Aug. 24, 2023, the entire contents of which are hereby incorporated by reference.

TECHNICAL FIELD

The present invention relates to an installation tool and an installation method that enable installation of a feed line.

BACKGROUND ART

A carrier, such as an over head hoist transport (OHT) and an over head shuttle (OHS), has been suitably used in the fields of semiconductor manufacturing, liquid crystal manufacturing, and the like as a device for transporting a transport target to a predetermined place with use of a carriage that travels on rails which are installed on the ceiling. Electric power supply to the carriage is carried out in a non-contact manner through a feed line laid on the rail. Such a feed line is held by a feed line holding part in a feed line holder supported by a rail, for example, as described in Patent Literature 1.

CITATION LIST

Patent Literature

[Patent Literature 1]
Japanese Patent Application Publication Tokukai No. 2002-337574

SUMMARY OF INVENTION

Technical Problem

The laying of such a feed line is usually carried out by a worker in the following manner. That is, the worker rides on a vehicle for work at height and installs the feed line in the feed line holder which is disposed at a high place. Such work is laborious and inefficient.

An object of an aspect of the present invention is to efficiently conduct work for installation of a feed line.

Solution to Problem

In order to solve the above problem, an installation tool in accordance with an aspect of the present invention is an installation tool for installing a feed line in a feed line holder, the feed line holder accompanying any of rails for allowing a carrier to travel thereon and holding the feed line, the feed line feeding electric power to the carrier in a non-contact manner, the installation tool including: a main body part configured to be capable of moving along the rails; and a pressing part configured to move together with the main body part along the rails and continuously press the feed line into a holding part of the feed line holder as the main body part is moved, the holding part being partially open.

In order to solve the above problem, an installation method in accordance with an aspect of the present invention is an installation method for installing a feed line in a feed line holder, the feed line holder accompanying any of rails for allowing a carrier to travel thereon and holding the feed line, the feed line feeding electric power to the carrier in a non-contact manner, the installation method including: a fitting step of fitting, to the feed line holder having a holding part which is partially open, a pressing part configured to press the feed line into the holding part as the pressing part is moved; and a movement step of moving the pressing part along the rails.

Advantageous Effects of Invention

According to an aspect of the present invention, it is possible to efficiently conduct work for installation of a feed line.

DESCRIPTION OF EMBODIMENTS

[Configuration of Transport System]

Figure 1:
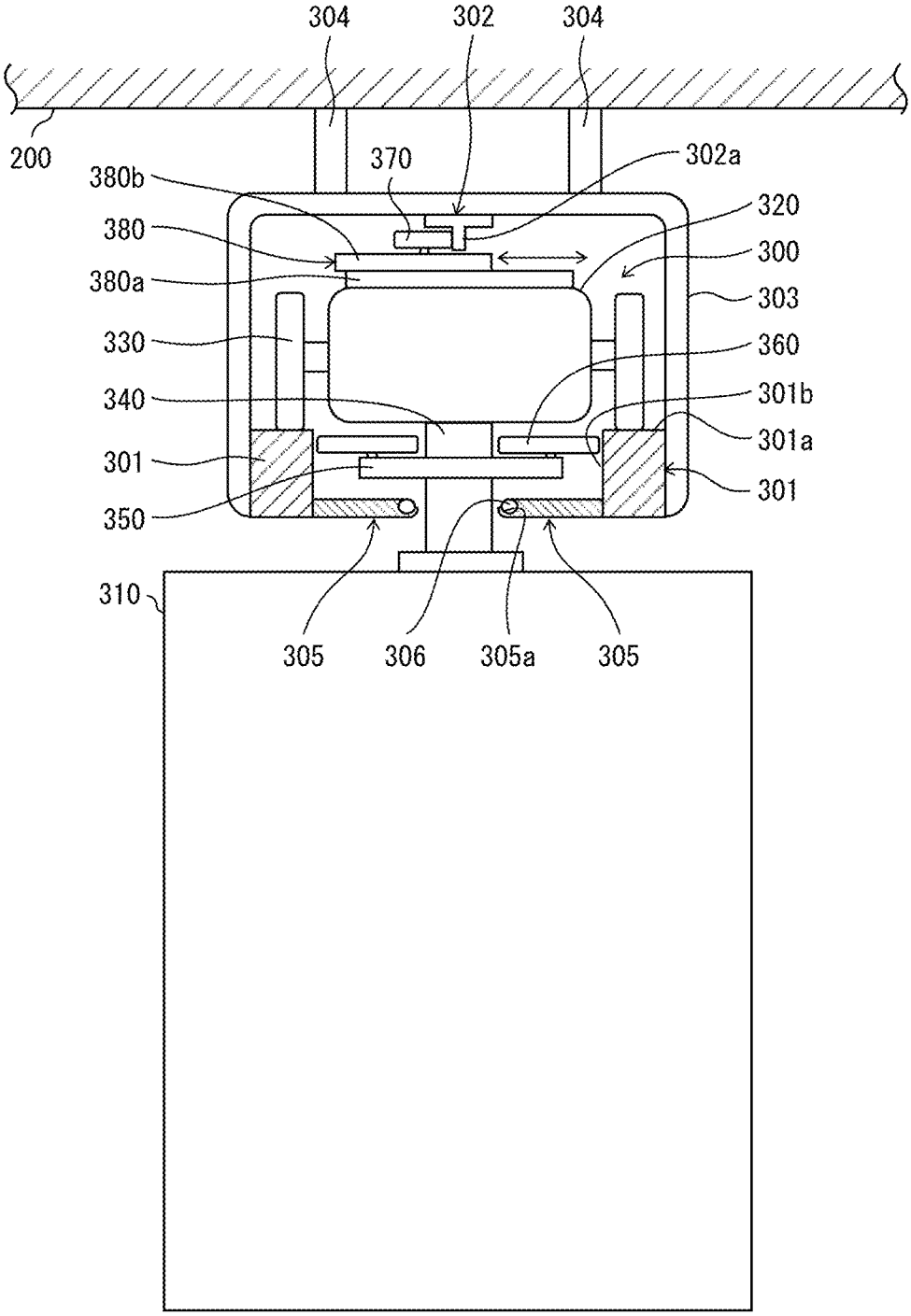
FIG. 1 is a front view illustrating a configuration of a transport system in which a feed line is installed with use of an installation tool in accordance with Embodiments 1, 2, and 3 of the present invention.

A transport system in which a feed line is installed with use of an installation tool in accordance with Embodiments 1 and 2 of the present invention will be described with reference to FIG. 1. FIG. 1 is a front view illustrating a configuration of the transport system in which a feed line is installed with use of an installation tool in accordance with Embodiments 1 and 2 of the present invention.

As illustrated in FIG. 1, the transport system is provided so as to be hung from a ceiling 200. The transport system includes a carrier 300, rails 301, an upper rail 302, holding frames 303, hanging brackets 304, feed line holders 305, and a feed line 306.

The rails 301 are provided to allow the carrier 300 to travel thereon and are a pair of rails that are disposed so as to be parallel to each other in a movement path of the carrier 300. The rails 301 are provided to lower portions of a plurality of holding frames 303 that are spaced on a movement path. The holding frames 303 are supported so as to be hung from the ceiling 200 by a plurality of hanging brackets 304.

The rails 301 each have an upper surface 301*a* and a side surface 301*b*. The upper surface 301*a* is a horizontal surface on which a wheel 330 (described later) of the carrier 300 rolls. The side surface 301*b* is a vertical surface on which a driven roller 360 (described later) of the carrier 300 abuts. The shape and internal structure of the rails 301 are not particularly limited, and the rails 301 are preferably formed to have a hollow structure from the viewpoint of weight reduction.

The upper rail 302 is provided in an area where one of the rails 301 is not present in a merging portion and a branching portion of the rails 301. The upper rail 302 supports the carrier 300 at the top of the carrier 300 and guides movement of the carrier 300 along the rails 301. The upper rail 302 is mounted on lower end surfaces of upper portions of the plurality of holding frames 303 and has a suspended part 302*a* that is suspended such that a slide roller 370 (described later) abuts on the suspended part 302*a*.

Each of the feed line holders 305 is provided so as to accompany the rails 301 to hold the feed line 306 which feeds power to the carrier 300 in a non-contact manner. Each of the feed line holders 305 is mounted on the side surface 301*b* of the rail 301 so as to follow the rail 301. In addition, each of the feed line holders 305 has a width that extends from the side surface 301*b* of the rail 301 to a position at or near a support shaft 340 (described later) of the carrier 300 in a horizontal direction.

Each of the feed line holders 305 has a holding part 305*a* that is provided at an edge portion thereof close to the support shaft 340 and that is partially open and, specifically, is open at an upper portion thereof. Since the holding part 305*a* is open at the upper portion thereof, it is possible to press the feed line 306 into the holding part 305*a* from above. The holding part 305*a* holds the feed line 306 which has been pressed thereinto.

The carrier 300 transports a container (not illustrated) to a destination by traveling on the rails 301 in a transport direction. Accommodated in the container are, for example, a wafer, a reticle, and the like which are used for manufacturing semiconductors. The carrier 300 has a box 310, drive parts 320, wheels 330, a support shaft 340, a support 350, driven rollers 360, a slide roller 370, and a slide mechanism 380.

The box 310 accommodates the container and has a transfer mechanism (not illustrated) disposed at an upper portion thereof. The box 310 is open on one side-surface side thereof such that the container can be taken in and out.

The drive parts 320 are sources of power for driving the wheels 330 and are each constituted by a motor or the like. The drive parts 320 are at least two drive parts that are provided in a transport direction and that are connected to each other by a connection mechanism (not illustrated). The wheels 330 are a pair of wheels that are disposed at positions where the wheels 330 can roll on corresponding upper surfaces 301*a* of the rails 301.

The support shaft 340 is a shaft member that supports the box 310 such that the box 310 is hung from the drive part 320. The support shaft 340 is provided so as to connect a bottom surface of the drive part 320 and a top surface of the box 310. Although not illustrated, a power reception part is provided inside the support shaft 340 at a position substantially facing the feed line holders 305. The power reception part receives, in a non-contact manner, electric power which is fed through the feed line 306 held in the feed line holder 305, and supplies the electric power to each component of the carrier 300.

The support 350 is provided to the support shaft 340 and has a horizontal surface. The support 350 supports the driven rollers 360 on the horizontal surface thereof so as to enable the driven rollers 360 to be rotated.

The driven rollers 360 are two pairs of driven rollers that are disposed on both sides of the support shaft 340 and abut on corresponding side surfaces 301*b* of the rails 301. The driven rollers 360 maintain the posture of the drive part 320 within a specified range in the horizontal direction by rolling on the corresponding side surfaces 301*b*.

The slide roller 370 is a roller that abuts on and rolls on the suspended part 302*a* of the upper rail 302. The slide roller 370 can be slid to a varying position in relation to the suspended part 302*a* in a direction of the width of the pair of rails 301, as indicated by an arrow in FIG. 1, so that the slide roller 370 can abut on either surface of both sides of the suspended part 302*a*. The slide roller 370, in the above-described area where one of the rails 301 is not present, abuts on the surface of the suspended part 302*a* on a side where the other one of the rails 301 is present, thereby maintaining the horizontal posture of the carrier 300 together with the other one of the rails 301.

The slide mechanism 380 is a mechanism that allows the slide roller 370 to slide to any position in a direction in which the slide roller 370 is moved. The slide mechanism 380 is provided on the drive part 320. The slide mechanism 380 has a fixing part 380*a*, which is fixed on the drive part 320, and a movement part 380*b*, which is moved on the fixing part 380*a*. The fixing part 380*a* is driven so as to slide the movement part 380*b*.

Embodiment 1

An installation tool in accordance with Embodiment 1 of the present invention will be described with reference to FIGS. 2 to 6.

<Configuration of Installation Tool>

Figure 2:
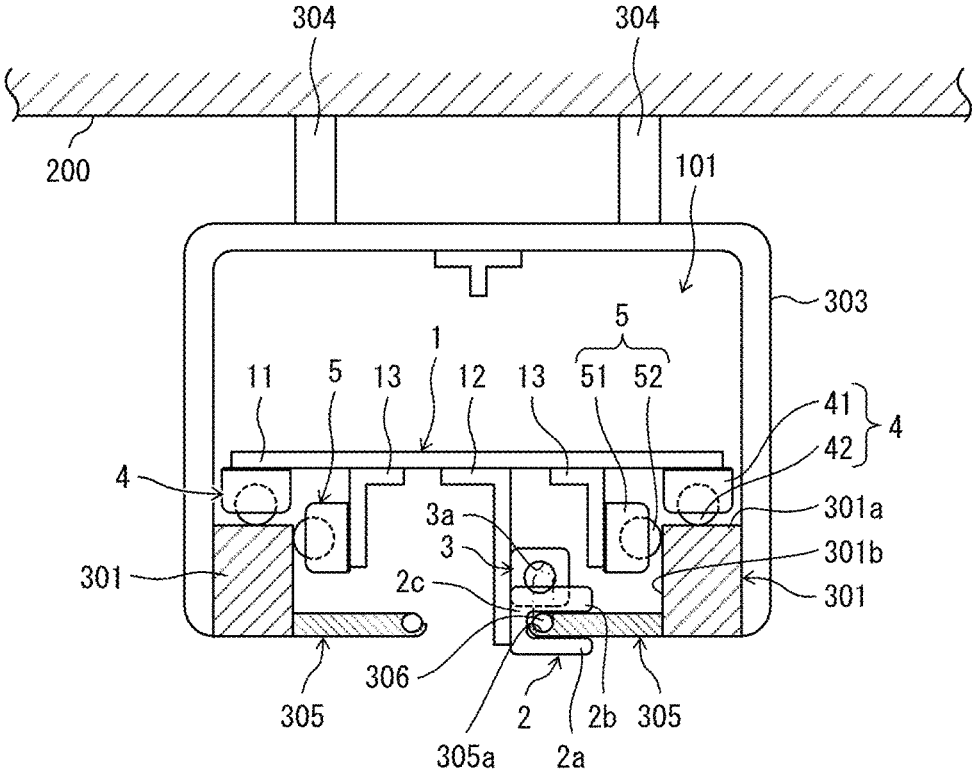
FIG. 2 is a front view illustrating a state in which an installation tool in accordance with Embodiment 1 of the present invention is placed on rails in the above-described transport system.
Figure 3:
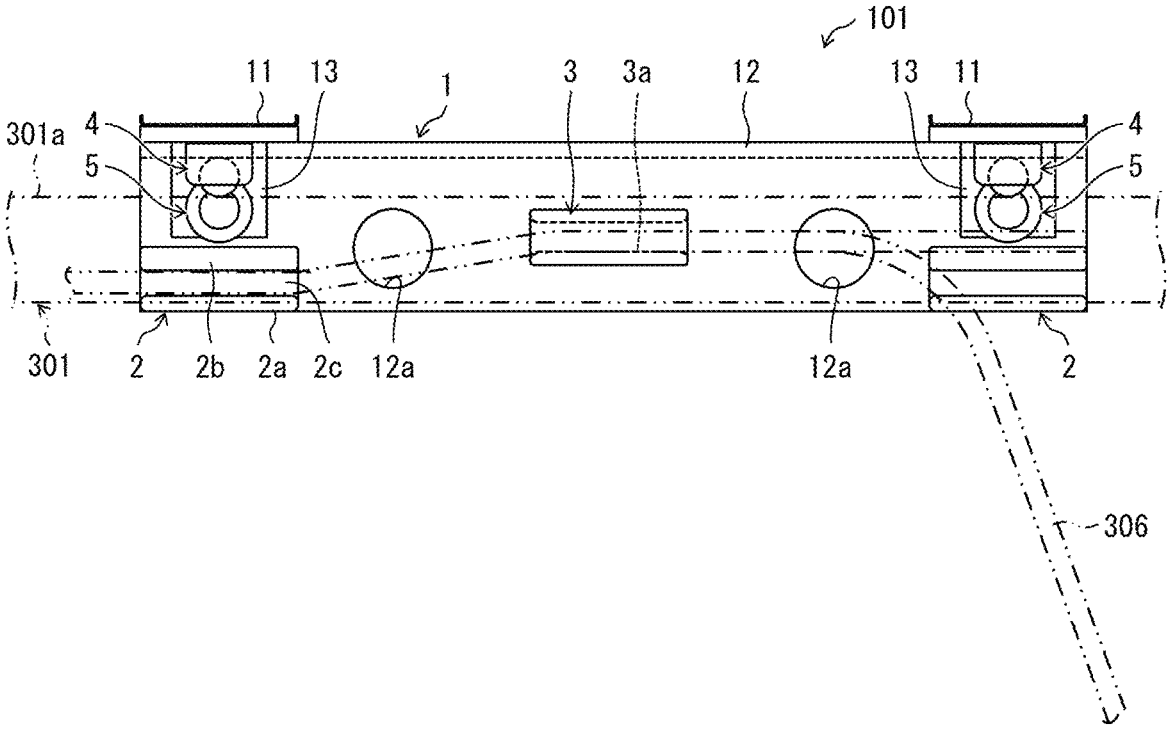
FIG. 3 is a side view illustrating the configuration of the installation tool.
Figure 4:
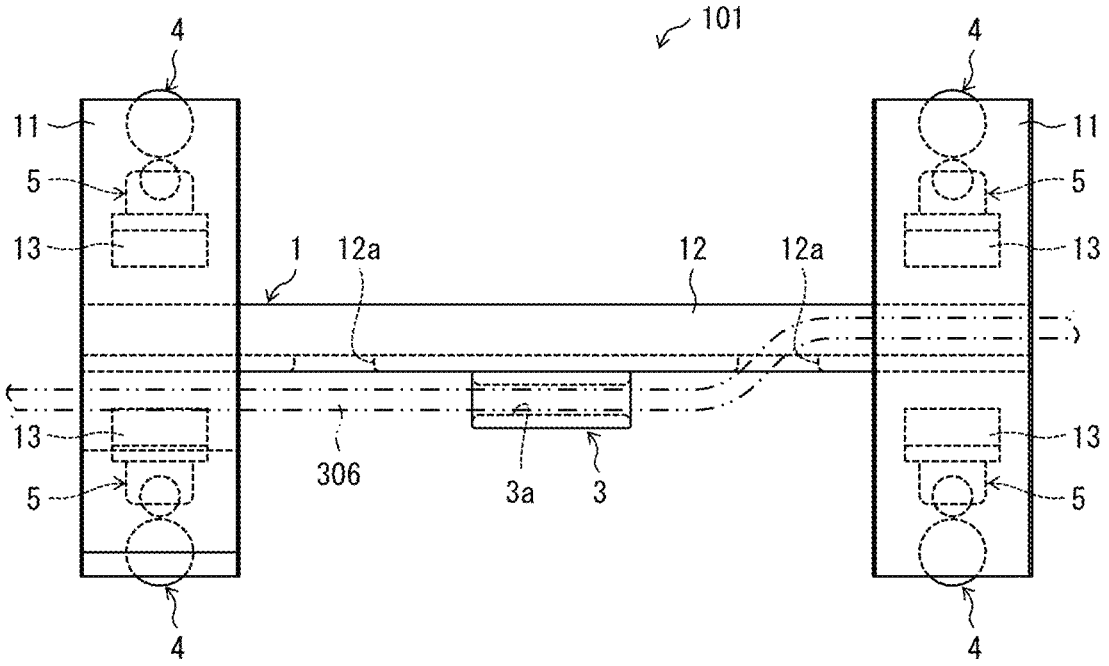
FIG. 4 is a plan view illustrating the configuration of the installation tool.
Figure 5:
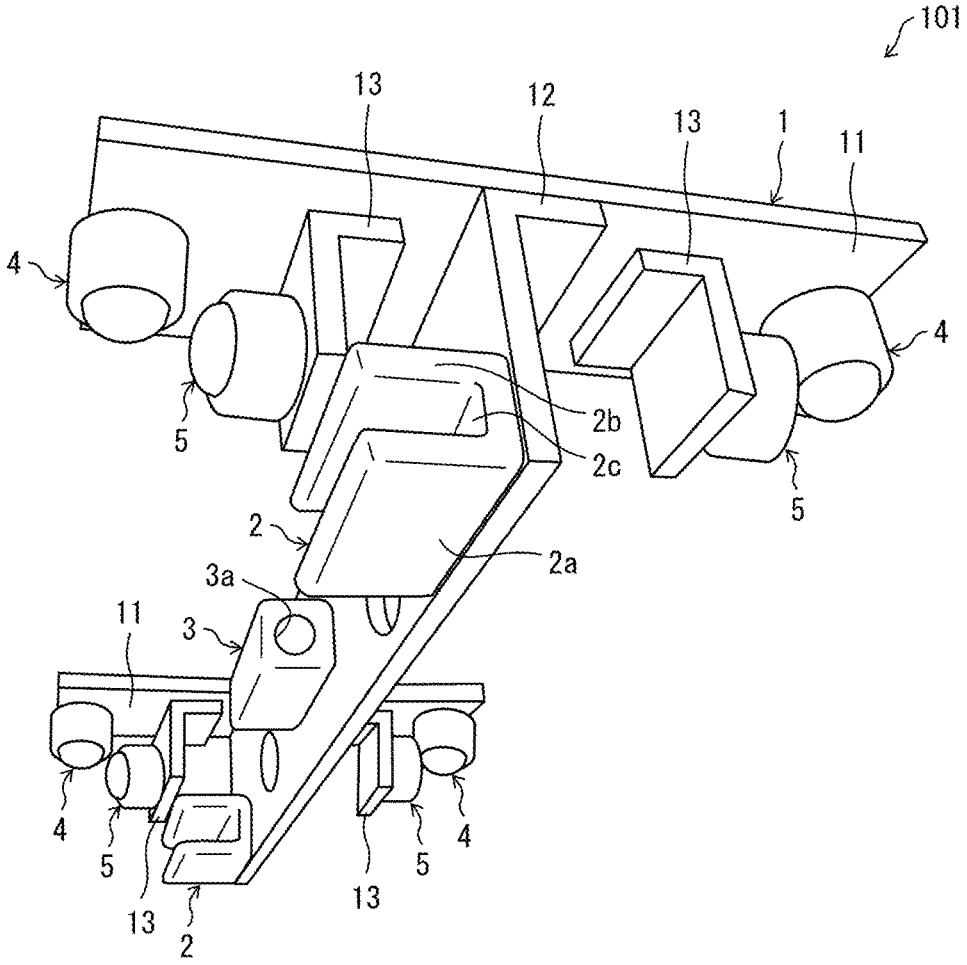
FIG. 5 is a perspective view illustrating the configuration of the installation tool.

FIG. 2 is a front view illustrating a state in which an installation tool 101 in accordance with Embodiment 1 of the present invention is placed on the rails in the above-described transport system. FIG. 3 is a side view illustrating the configuration of the installation tool 101. FIG. 4 is a plan view illustrating the configuration of the installation tool 101. FIG. 5 is a perspective view illustrating the configuration of the installation tool 101.

As illustrated in FIGS. 2 to 5, the installation tool 101 has a main body part 1, a pressing part 2, a support part 3, a plurality of moving and rolling parts 4 (rolling parts), and a plurality of regulating and rolling parts 5 (rolling parts). The installation tool 101 is moved on the rails 301 by a worker pulling on a rope, as will be described later. Therefore, the installation tool 101 is preferably lightweight and is formed of, for example, resin.

The main body part 1 is configured to be capable of moving along the rails 301. The main body part 1 has movement support parts 11, a base body part 12, and rolling leg parts 13.

The movement support parts 11 are two plate-like members each forming a rectangle. The movement support parts 11 are disposed such that lengthwise sides of the movement support parts 11 face corresponding widthwise sides of the pair of rails 301. Further, the pair of movement support parts 11 are disposed at a predetermined interval in a direction in which the installation tool 101 is moved.

The base body part 12 is a plate-like member and has an upper end surface which is fixed, at opposite end portions thereof, on corresponding lower surfaces of the pair of movement support parts 11. In this way, the base body part 12 constitutes a basic structure of the main body part 1. The base body part 12 is disposed so as to be suspended with respect to the movement support parts 11.

The base body part 12 has holes 12*a* (hanging structure) respectively provided at two positions closer to the center of the base body part 12 than to the opposite end portions thereof. The holes 12*a* are provided to allow a rope for moving the main body part 1 to be drawn therethrough and hung when the feed line 306 is installed in the feed line holder 305. The holes 12*a* are provided in the base body part 12 in an area defined between the moving and rolling part 4 which is provided at a front end portion of the main body part 1 in the direction in which the main body part 1 is moved and the moving and rolling part 4 which is provided at a rear end portion of the main body part 1 in the direction in which the main body part 1 is moved. More specifically, the holes 12*a* are provided in the base body part 12 such that one of the holes 12*a* is provided between the support part 3 and the moving and rolling part 4 which is provided at the front end portion of the main body part 1, and the other one of the holes 12*a* is provided between the support part 3 and the moving and rolling part 4 which is provided at the rear end portion of the main body part 1. The moving and rolling parts 4 will be described in detail later.

Note that the hanging structure is not limited to the holes 12*a*, and may be a structure such as a hook, provided that the hanging structure is a structure that allows the rope to be hung.

The rolling leg parts 13 are provided to fix the regulating and rolling parts 5. The rolling leg parts 13 are fixed on the lower surface of each of the movement support parts 11 at positions spaced from opposite surfaces of the base body part 12. The rolling leg parts 13 are disposed so as to be suspended from the lower surface of each of the movement support parts 11.

The pressing part 2 is configured to move together with the main body part 1 along the rails 301 and continuously press the feed line 306 into the holding part 305*a* of the feed line holder 305 as the main body part 1 is moved. The pressing part 2 is removably mounted on any of lower portions of the opposite end portions of the opposite surfaces of the base body part 12 by fastening of a bolt and a nut. The pressing part 2 is formed of a material having a small friction coefficient so as not to cause damage to the feed line 306 due to friction because the pressing part 2 comes into strong contact with the feed line 306. As such a material, ultra-high molecular weight polyethylene is suitable.

In work for installation of the feed line 306, the pressing part 2 is mounted on at least one end portion of one of the opposite surfaces of the base body part 12. Specifically, the pressing part 2 is mounted on the rear end portion thereof in the direction in which the main body part 1 is moved. Thus, according to a direction in which the installation tool 101 is moved, a mounting position of the pressing part 2 can be selected from two mounting positions.

The pressing part 2 has a lower portion 2*a*, an upper portion 2*b* (abutting portion), and a mounting portion 2*c*. The lower portion 2*a* is formed so as to be parallel to a lower surface of the feed line holder 305 in a state in which the installation tool 101 is placed on the rails 301. The upper portion 2*b* is formed so as to be parallel to the lower portion 2*a* with an interval which is provided between the upper portion 2*b* and the lower portion 2*a* and which is slightly wider than the thickness of the feed line holder 305. The upper portion 2*b* is placed in the vicinity of a top of the feed line holder 305 in a state in which the installation tool 101 is placed on the rails 301. Thus, the upper portion 2*b* abuts, from above, on the feed line 306 which is to be introduced into the pressing part 2 as the pressing part 2 is moved. The mounting portion 2*c* is a portion that is to be mounted on the base body part 12, and is connected to one end edge of the lower portion 2*a* and one end edge of the upper portion 2*b*.

The support part 3 supports the feed line 306 which is to be introduced into the pressing part 2. The support part 3 is fixed on the surface of the base body part 12 on which the pressing part 2 is mounted, so as to move together with the main body part 1 along the rails 301. The support part 3 is disposed in the center of the base body part 12 so as to be positioned forward of the pressing part 2 in the direction in which the main body part 1 is moved. The support part 3 is disposed at a position higher than the pressing part 2. Further, the support part 3 has a through hole 3*a* that penetrates so as to extend in the lengthwise direction of the base body part 12 and that has a diameter larger than the diameter of the feed line 306.

The moving and rolling parts 4 are each a rolling mechanism that allows the main body part 1 to move by rolling on the corresponding rails 301. The moving and rolling parts 4 are provided on a one-to-one basis on opposite end portions of the movement support part 11. The moving and rolling parts 4 each have a holder 41 and a spherical body 42. The holder 41 is fixed on the lower surface of the movement support part 11 at the opposite ends of the movement support part 11, and holds the spherical body 42 so as to enable the spherical body 42 to rotate and so as to prevent the spherical body 42 from coming off. The spherical body 42 is positioned on the upper surface 301*a* of each of the rails 301 in a state in which the installation tool 101 is placed on the rails 301.

Like the moving and rolling parts 4, the regulating and rolling parts 5 are each a rolling mechanism that allows the main body part 1 to move by rolling on the corresponding rails 301. Further, the regulating and rolling parts 5 each have a function of regulating the position of the main body part 1 in the direction of the width of the pair of rails 301 when the main body part 1 is moved on the rails 301, and are provided on the corresponding rolling leg parts 13. The regulating and rolling parts 5 each have a holder 51 and a spherical body 52. The holder 51 is fixed on a surface of each of the rolling leg parts 13 which faces a corresponding one of the rails 301, and holds the spherical body 52 so as to enable the spherical body 52 to rotate and so as to prevent the spherical body 52 from coming off. The spherical body 52 rolls on the side surface 301*b* of each of the rails 301 in a state in which the installation tool 101 is placed on the rails 301.

<Method for Installing Feed Line with Use of Installation Tool>

Figure 6:
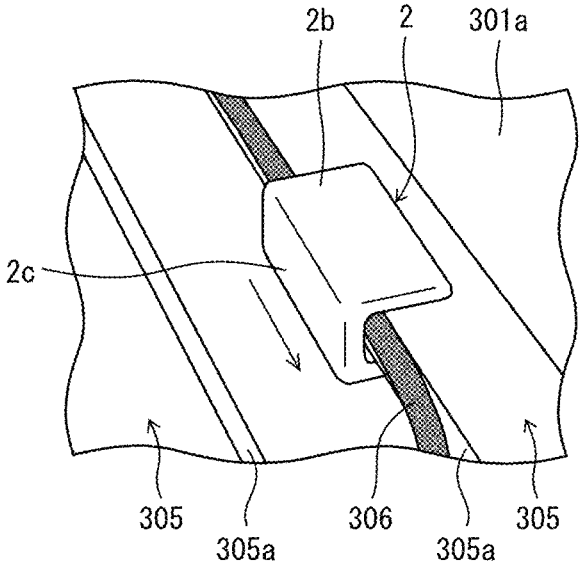
FIG. 6 is a perspective view illustrating a state in which a pressing part mounted to the installation tool is fitted to a feed line holder which is attached to any of the rails.

FIG. 6 is a perspective view illustrating a state in which the pressing part 2 mounted to the installation tool 101 is fitted to the feed line holder 305 which is attached to any of the rails 301.

First, the worker fits the pressing part 2 to the feed line holder 305. Thus, the worker rides on a platform so that the worker can work at a high place, and forces, into the holding part 305*a* of the feed line holder 305, a part of the feed line 306 having been drawn out from a draw-out part (not illustrated) from which the feed line 306 is drawn out by manually pressing the part of the feed line 306 into the holding part 305*a* of the feed line holder 305. As illustrated in FIG. 6, the worker fits the pressing part 2 to an end portion of the feed line holder 305 into which the feed line 306 has been forced, so that the pressing part 2 is inserted into the feed line holder 305 (fitting step).

Next, the worker places the main body part 1 on the rails 301 as illustrated in FIG. 2 prior to the movement of the installation tool 101 (placement step). In the placement step, the worker mounts, on the main body part 1, the pressing part 2 which has been fitted to the feed line holder 305 (mounting step). Further, in the placement step, as illustrated in FIG. 3, the worker lifts the feed line 306 jutting out of the pressing part 2, passes the feed line 306 through the through-hole 3*a* of the support part 3, and causes the rope to be hung down from the holes 12*a* of the base body part 12.

When the placement of the installation tool 101 has been completed in this manner, a worker who has waited below moves the installation tool 101 along the rails 301 by pulling on the rope from diagonally below in front of the installation tool 101 in a direction in which the installation tool 101 is moved (movement step). With the movement of the installation tool 101, as illustrated in FIG. 6, as the pressing part 2 is moved in the direction indicated by the arrow, the upper portion 2*b* abuts, from above, on the feed line 306 which is to be introduced into the pressing part 2. Thus, the feed line 306 is pushed downward into the holding part 305*a* which is open in the upper portion thereof.

When the installation tool 101 is moved, the support part 3 supports, at a position higher than the pressing part 2, the feed line 306 which is to be introduced into the pressing part 2, as illustrated in FIG. 3. This makes it possible to reduce the load applied to the pressing part 2, as compared with the structure in which the feed line 306 hanging downward is directly introduced into the pressing part 2. As a result, the feed line 306 is easily introduced into the pressing part 2.

Conventionally, the installation of the feed line 306 is carried out by the worker in the following manner. That is, the worker rides on a vehicle for work at height, forces the feed line 306 into the holding part 305*a* of the feed line holder 305 which is disposed at a high place by manually pressing the feed line 306 into the holding part 305*a* of the feed line holder 305. The worker is not permitted by law to conduct such work in a state in which the vehicle for work at height on which the worker is riding is moving. Thus, when the worker has completed the work in an accessible area, the worker goes down from the vehicle for work at height, and, when the vehicle for work at height is moved to the next work location, the worker climbs back to the vehicle for work at height to conduct the work. This is repeatedly done. Therefore, the work is laborious and inefficient.

In contrast, in the present embodiment, moving the installation tool 101 makes it possible to install the feed line 306 in the feed line holder 305. Thus, the worker climbs up to a high place and climbs down from the high place when the installation tool 101 needs to be placed on the rails 301 or when the installation tool 101 needs to be removed from the rails 301. Accordingly, it is possible to greatly reduce the number of times the worker climbs up and down. Therefore, it is possible to reduce the work of the worker pressing the feed line 306 into the feed line holder 305 and improve the efficiency of the work. The same applies to Embodiment 2 which will be described later.

As described above, the installation tool 101 is moved on the rails 301 by the worker pulling on the rope. However, the installation tool 101 may be configured to include a drive source so that the installation tool 101 travels on the rails 301 under its own power. Note, however, that, in a case where the installation tool 101 is configured to travel in a self-propelled manner, for example, the following control needs to be performed. That is, in a place where the placement of the installation tool 101 on the rails 301 and the removal of the installation tool 101 from the rails 301 are relatively frequently performed, it is necessary to detect such a place and stop movement of the installation tool 101. Furthermore, handling of the installation tool 101 becomes difficult because of an increase in the weight of the installation tool 101. In contrast, the installation tool 101 in accordance with the present embodiment can freely be moved or stopped since the installation tool 101 is moved under the force of the worker. Furthermore, the installation tool 101 in accordance with the present embodiment is lightweight and easy to handle. Therefore, it is possible to efficiently perform the work for installation of the feed line 306. The same applies to an installation tool 102 (see FIG. 7) in accordance with Embodiment 2 which will be described later and an installation tool 103 (see FIG. 17) in accordance with Embodiment 3 which will be described later.

Embodiment 2

An installation tool in accordance with Embodiment 2 of the present invention will be described with reference to FIGS. 7 to 16. Note that, for convenience of description, a member having a function identical to that of a member described in Embodiment 1 is given an identical reference sign, and a description thereof is omitted.

<Configuration of Installation Tool>

Figure 7:
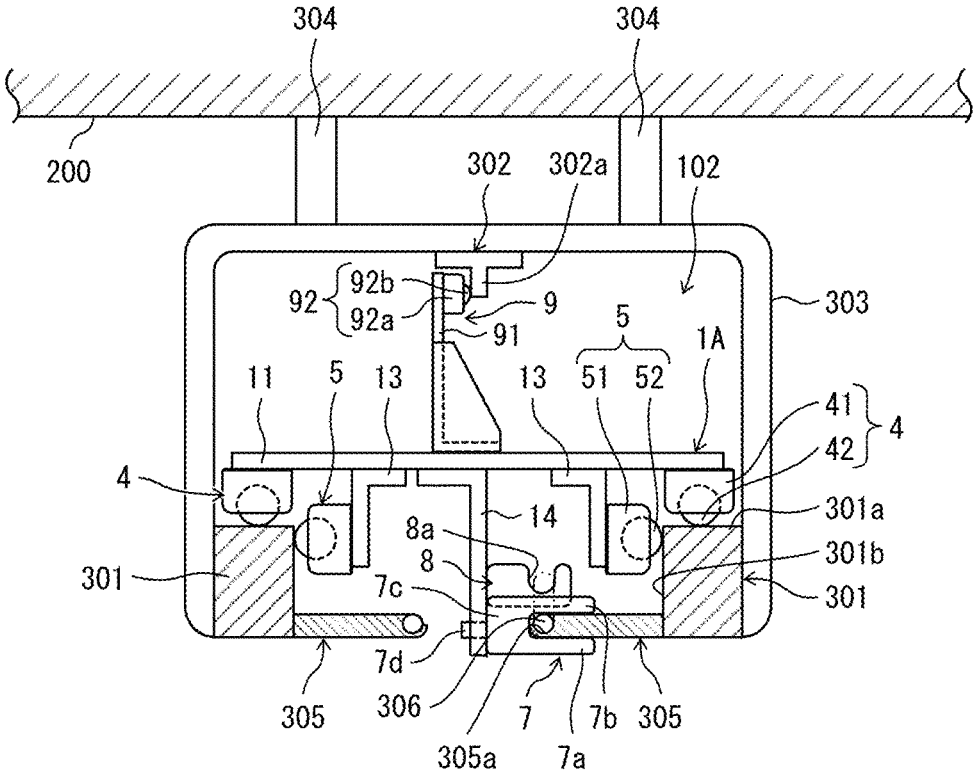
FIG. 7 is a front view illustrating a state in which an installation tool in accordance with Embodiment 2 of the present invention is placed on the rails in the above-described transport system.
Figure 8:
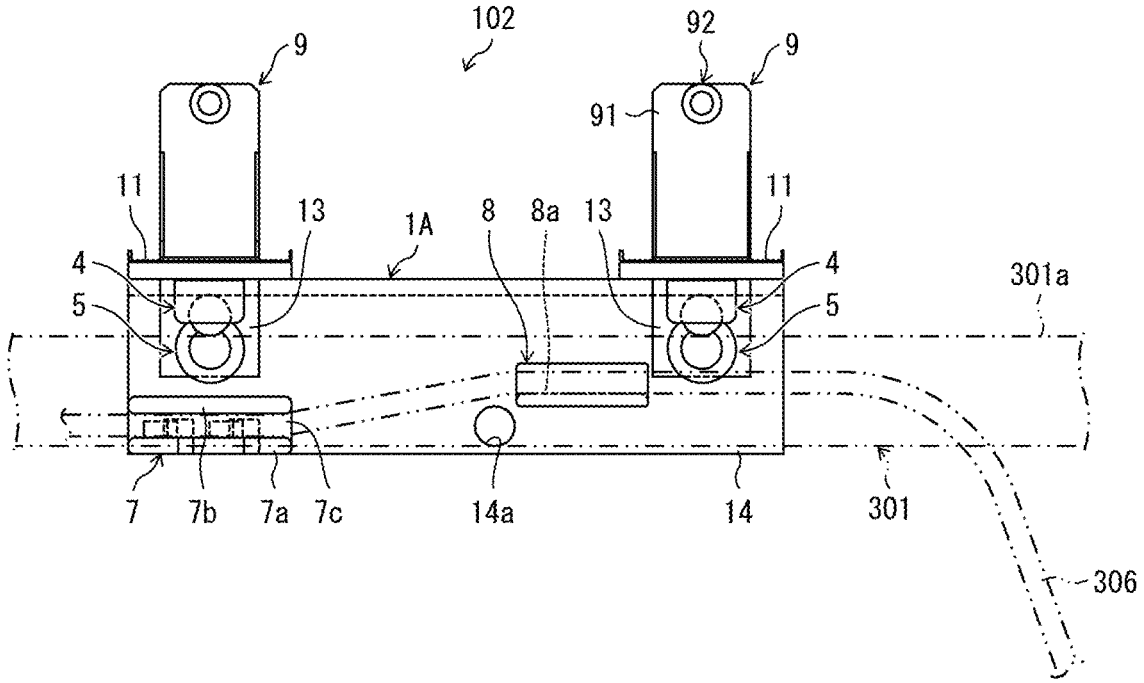
FIG. 8 is a side view illustrating the configuration of the installation tool illustrated in FIG. 7.
Figure 9:
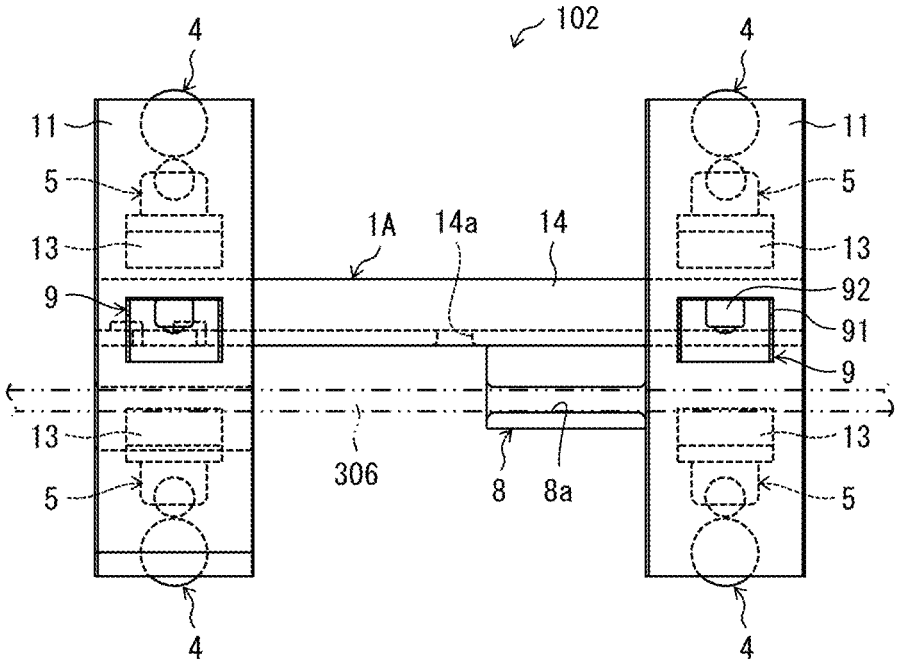
FIG. 9 is a plan view illustrating the configuration of the installation tool illustrated in FIG. 7.
Figure 10:
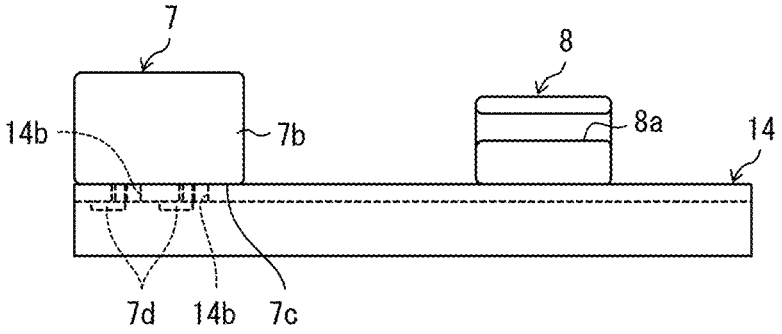
FIG. 10 is a plan view illustrating a state of a base body part on which a pressing part and a support part are mounted in the installation tool illustrated in FIG. 7.
Figure 11:
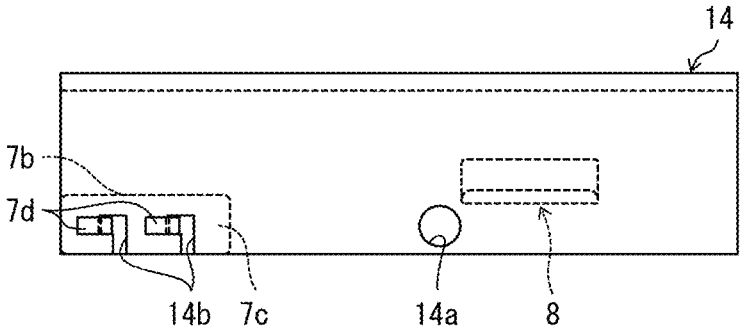
FIG. 11 is a side view illustrating the state of the base body part on which the pressing part and the support part are mounted.
Figure 12:
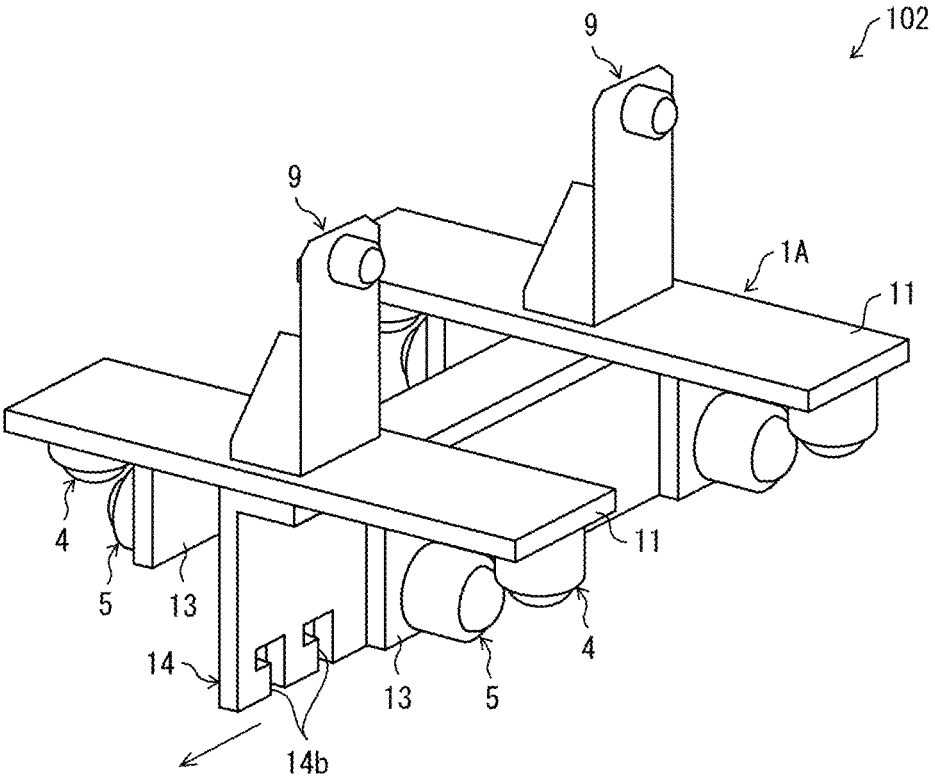
FIG. 12 is a perspective view illustrating the configuration of the installation tool illustrated in FIG. 7.
Figure 13:
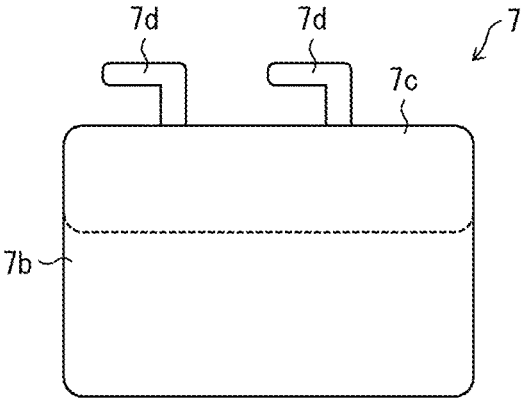
FIG. 13 is a plan view illustrating the configuration of the pressing part illustrated in FIG. 10.
Figure 14:
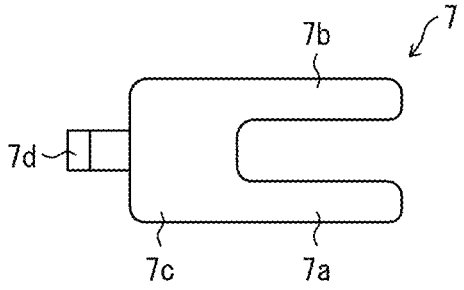
FIG. 14 is a side view illustrating the configuration of the pressing part illustrated in FIG. 10.
Figure 15:
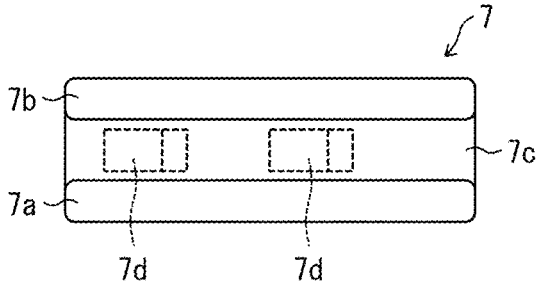
FIG. 15 is a front view illustrating the configuration of the pressing part illustrated in FIG. 10.

FIG. 7 is a front view illustrating a state in which an installation tool 102 in accordance with Embodiment 2 of the present invention is placed on the rails 301 in the transport system. FIG. 8 is a side view illustrating the configuration of the installation tool 102. FIG. 9 is a plan view illustrating the configuration of the installation tool 102. FIG. 10 is a plan view illustrating a state of a base body part 14 on which a pressing part 7 and a support part 8 are mounted in the installation tool. FIG. 11 is a side view illustrating the state of the base body part 14 on which the pressing part 7 and the support part 8 are mounted. FIG. 12 is a perspective view illustrating the configuration of the installation tool 102. FIG. 13 is a plan view illustrating the configuration of the pressing part 7. FIG. 14 is a side view illustrating the configuration of the pressing part 7. FIG. 15 is a front view illustrating the configuration of the pressing part 7.

As illustrated in FIGS. 7 to 12, the installation tool 102 has a main body part 1A, a plurality of moving and rolling parts 4, a plurality of regulating and rolling parts 5, a pressing part 7, a support part 8, and a pair of displacement regulating parts 9 (maintaining parts). The installation tool 102 is moved on the rails 301 by the worker pulling on a rope, as described later. Thus, like the installation tool 101, the installation tool 102 is preferably lightweight. For this reason, the installation tool 102 is formed of resin.

The main body part 1A is configured to be capable of moving along the rails 301. The main body part 1A has movement support parts 11, rolling leg parts 13, and a base body part 14.

The base body part 14 has an upper end surface which is fixed, at opposite end portions thereof, on corresponding lower surfaces of the pair of movement support parts 11. In this way, the base body part 14 constitutes a basic structure of the main body part 1A. The base body part 14 is disposed so as to be suspended with respect to the movement support parts 11. The base body part 14 is formed to be shorter than the base body part 12 of the installation tool 101 in Embodiment 1 because a place at which the pressing part 7 is mounted (described later) is limited to one place.

The base body part 14 has a hole 14*a* (hanging structure) provided in a substantially central portion thereof. The hole 14*a* is provided to allow a rope for moving the main body part 1A to be drawn therethrough and hung when the feed line 306 is installed in the feed line holder 305. The hole 14*a* is provided in an area defined between the moving and rolling part 4 which is provided at a front end portion of the main body part 1A in the direction in which the main body part 1A is moved and the moving and rolling part 4 which is provided at a rear end portion of the main body part 1A in the direction in which the main body part 1 is moved. More specifically, the hole 14*a* is provided in the base body part 14 at or near a midpoint position between the moving and rolling part 4 which is provided at the front end portion and the moving and rolling part 4 which is provided at the rear end portion. Alternatively, the hole 14*a* may be provided at a position slightly rearward of the support part 8 in the base body part 14.

Note that the hanging structure is not limited to the hole 14*a*, and may be a structure such as a hook, provided that the hanging structure is a structure that allows the rope to be hung.

As illustrated in FIGS. 10 and 11, the base body part 14 has two notches 14*b*. The notches 14*b* are provided in an end portion of the base body part 14 where the pressing part 7 is mounted. Specifically, the notches 14*b* are provided in a lower portion of a rear end portion of the base body part 14 in the direction in which the main body part 1A is moved. The notches 14*b* are each formed so as to have a portion extending upward from a lower end of the base body part 14 and a portion extending toward a rear end portion of the base body part 14 along a direction in which the main body part 1A is moved.

The pressing part 7 is configured to move together with the main body part 1A along the rails 301 and continuously press the feed line 306 into the holding part 305*a* of the feed line holder 305 as the main body part 1A is moved. The pressing part 7 is disposed on one end portion of one of opposite surfaces of the base body part 14. Specifically, the pressing part 7 is disposed on a rear end portion of the base body part 14 in the direction in which the main body part 1A is moved. The pressing part 7 is removably mounted on a lower portion of the rear end portion of the base body part 14 by an engagement structure with the notches 14*b*. Like the pressing part 2 in the installation tool 102 in Embodiment 1, the pressing part 7 is formed of a material having a small friction coefficient.

As illustrated in FIGS. 13 to 15, the pressing part 7 has a lower portion 7*a*, an upper portion 7*b* (abutting portion), a mounting portion 7*c*, and engagement portions 7*d*. The lower portion 7*a*, the upper portion 7*b*, and the mounting portion 7*c* have substantially the same structure as the lower portion 2*a*, the upper portion 2*b*, and the mounting portion 2*c* of the pressing part 2 in the installation tool 101 described above.

The engagement portions 7*d* are two engagement portions which are provided on the mounting portion 7*c* and are disposed so as to be spaced from each other. The engagement portions 7*d* are each formed in a hook-like manner so as to be engaged with the corresponding notches 14*b* of the base body part 14. The engagement portions 7*d* each have a projecting portion that projects vertically from the mounting portion 7*c* and a bent portion that is bent from an end of the projecting portion to the left when viewed in a plan view in FIG. 13.

The support part 8 supports the feed line 306 which is to be introduced into the pressing part 7. The support part 8 is fixed on the surface of the base body part 14 on which the pressing part 8 is mounted, so as to move together with the main body part 1A along the rails 301. The support part 8 is disposed at a position slightly forward of the center of the base body part 14 so as to be positioned forward of the pressing part 7 in the direction in which the main body part 1A is moved. The support part 8 is disposed at a position higher than the pressing part 7. Further, the support part 8 is formed so as to extend in the lengthwise direction of the base body part 14 and has a groove 8*a* that guides the feed line 306.

The displacement regulating parts 9, by abutting on the suspended part 302*a* of the upper rail 302, regulate the displacement of the main body part 1A in the direction of the width of the pair of rails 301, and maintain the posture of the main body part 1A. The displacement regulating parts 9 each have a support member 91 and a rolling portion 92.

The support member 91 is provided so as to stand in a substantially central portion of an upper surface of the movement support part 11. The support member 91 has a bottom plate, a standing plate that stands on the bottom plate, and reinforcing plates that are provided on opposite sides of the standing plate to ensure strength.

The rolling portion 92 is provided on an upper end portion of the support member 91. The rolling portion 92 has a holder 92*a* and a spherical body 92*b*. The holder 92*a* is fixed on one surface of the upper end portion of the support member 91, and holds the spherical body 92*b* so as to enable the spherical body 92*b* to rotate and so as to prevent the spherical body 92*b* from coming off. The spherical body 92*b* rolls on the suspended part 302*a* of the upper rail 302 in a state in which the installation tool 102 is placed on the rails 301.

Note that, although each of the displacement regulating parts 9 has one rolling portion 92, each of the displacement regulating parts 9 may have two rolling portions 92 that differ from each other in that spherical bodies 92*b* protrude from holders 92*a* in different directions. Although not illustrated, the other rolling portion 92 differs from the rolling portion 92 illustrated in FIG. 7 in that the spherical body 92*b* of the other rolling portion 92 protrudes from the holder 92*a* in a reverse direction, and the other rolling portion 92 is fixed to a support member different from the support member 91. Such a support member is formed so as to extend vertically to the support member 91 from a substantially central position of the support member 91. Further, the support member 91 has a rotation mechanism that enables the support member 91 to turn on the upper surface of the movement support part 11.

The displacement regulating parts 9 configured as described above can each switch the posture, when the support member 91 is turned, between a position where the rolling portion 92 abuts on one surface of the suspended part 302*a* of the upper rail 302 and a position where the other rolling portion 92 abuts on the other surface of the suspended part 302*a*. In a state in which each rolling portion 92 abuts on the surface of the suspended part 302*a*, the support member 91 is fixed so as not to turn. In this way, switching between the two rolling portions 92 makes it possible to cause one of the two rolling portions 92 to abut on one of the two surfaces of the suspended part 302*a*. Thus, even in an area where one of the rails 301 is not present in the merging portion and the branching portion of the rails 301, it is possible to maintain the posture of the installation tool 102 without repositioning the installation tool 102 by changing the orientation of the installation tool 102.

<Method for Installing Feed Line with Use of Installation Tool>

Figure 16:
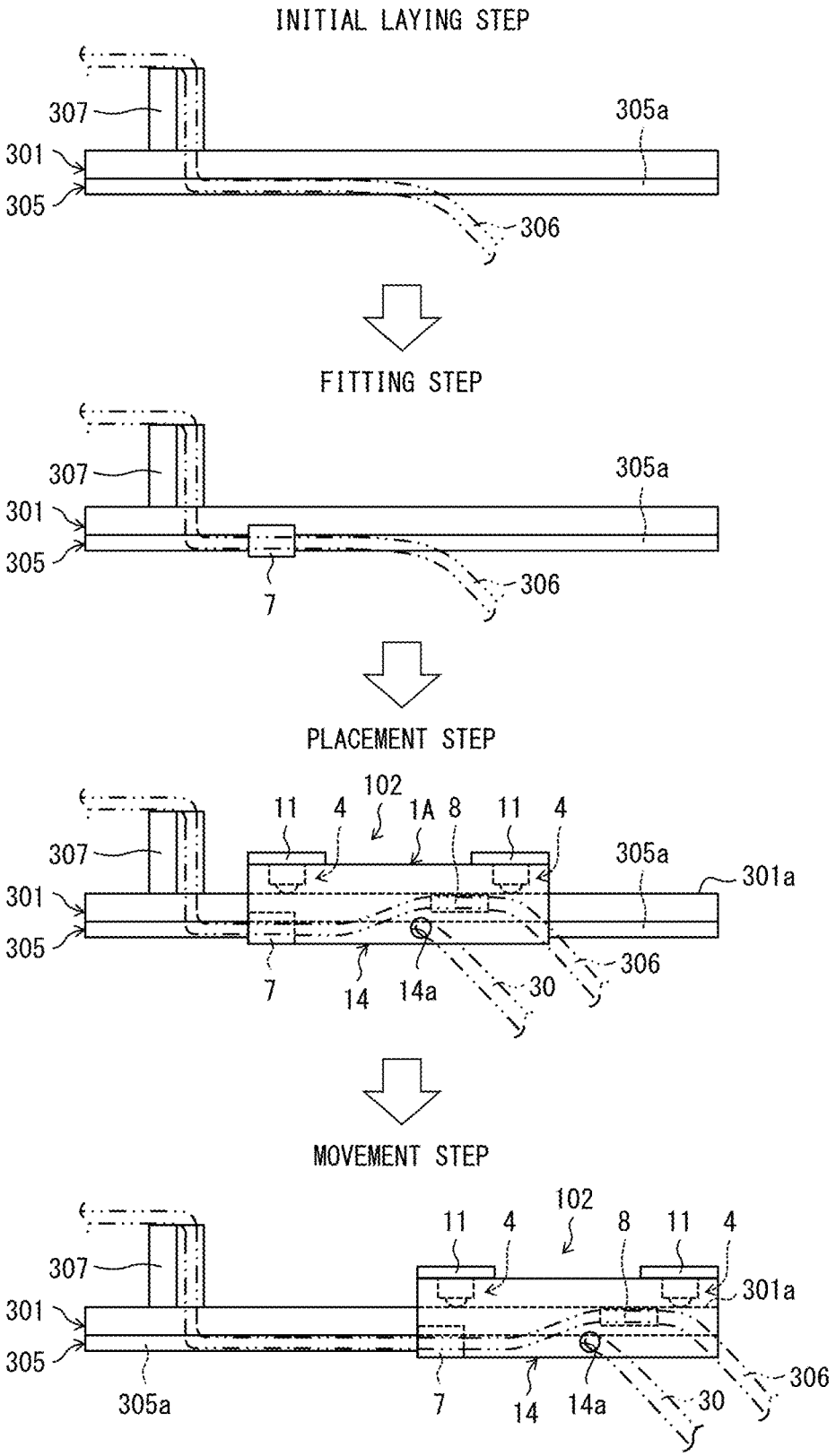
FIG. 16 is a view illustrating steps for the installation of the feed line in the feed line holder with use of the installation tool illustrated in FIG. 7.

FIG. 16 is a view illustrating steps for the installation of the feed line 306 in the feed line holder 305 with use of the installation tool 102.

As illustrated in FIG. 16, first, a worker, on a platform, forces, into the holding part 305*a* of the feed line holder 305, a part of the feed line 306 having been drawn out from a draw-out part 307 for the feed line 306 by pressing the part of the feed line 306 into the holding part 305*a* of the feed line holder 305 (initial laying step). As illustrated in FIG. 16, the worker fits the pressing part 7 to an end portion of the feed line holder 305 into which the feed line 306 has been forced, so that the pressing part 7 is inserted into the feed line holder 305 (fitting step).

Next, the worker places the main body part 1A on the rails 301 (placement step). In the placement step, the worker mounts, on the main body part 1A, the pressing part 7 which has been fitted to the feed line holder 305 (mounting step). The mounting of the pressing part 7 on the main body part 1A completes the installation tool 102. In the placement step, the worker lifts the feed line 306 jutting out of the pressing part 7, places the feed line 306 in the groove of the support part 8, and causes the rope 30 to be hung down from the hole 14*a* 30 of the base body part 14.

In the mounting step, the worker inserts the projecting portions of the engagement portions 7*d* of the pressing part 7 illustrated in FIG. 13 into the notches 14*b* in the base body part 14 illustrated in FIG. 12, from the lower ends of the notches 14*b* to the upper ends thereof, and moves the projecting portions backward in the direction indicated by an arrow in FIG. 12, that is, in the direction in which the installation tool 102 is moved.

Thus, when the main body part 1A moves on the rails 301, the pressing part 7 receives resistance due to contact with the feed line 306, so that the engagement portions 7*d* move toward the rear of the installation tool 102. Therefore, the engagement portions 7*d* do not come off from the notches 14*b*. Hence, the pressing part 7 can be easily joined to the main body part 1A (base body part 14) without using screws.

When the placement of the installation tool 102 has been completed in this manner, a worker who has waited below moves the installation tool 102 along the rails 301 by pulling on a rope 30 in front of the installation tool 102 in a direction in which the installation tool 102 is moved (movement step). With the movement of the installation tool 101, as the pressing part 7 is moved, the upper portion 7*b* abuts, from above, on the feed line 306 which is to be introduced into the pressing part 7. Thus, the feed line 306 is pressed downward into the holding part 305*a* which is open in the upper portion thereof.

When the main body part 1A is pulled with the rope 30, the moment of the entire installation tool 102 is easily balanced by an upward reaction force received by the moving and rolling part 4 from the rail 301 and a force acting on the hole 14*a* diagonally downward through the rope 30. Therefore, it is possible to stably pull the main body portion 1A.

When the installation tool 102 is moved, the support part 3 supports, at a position higher than the pressing part 2, the feed line 306 which is to be introduced into the pressing part 2. This makes it possible to reduce the load applied to the pressing part 2, as compared with the structure in which the feed line 306 hanging downward is directly introduced into the pressing part 2. As a result, the feed line 306 is easily introduced into the pressing part 2.

Thus, moving the installation tool 102 makes it possible to install the feed line 306 in the feed line holder 305. Therefore, as in Embodiment 1, it is possible to reduce the work of the worker pressing the feed line 306 into the feed line holder 305.

Embodiment 3

An installation tool in accordance with Embodiment 3 of the present invention will be described with reference to FIGS. 17 to 27. Note that, for convenience of description, a member having a function identical to that of a member described in Embodiments 1 and 2 is given an identical reference sign, and a description thereof is omitted.

<Configuration of Installation Tool>

Figure 17:
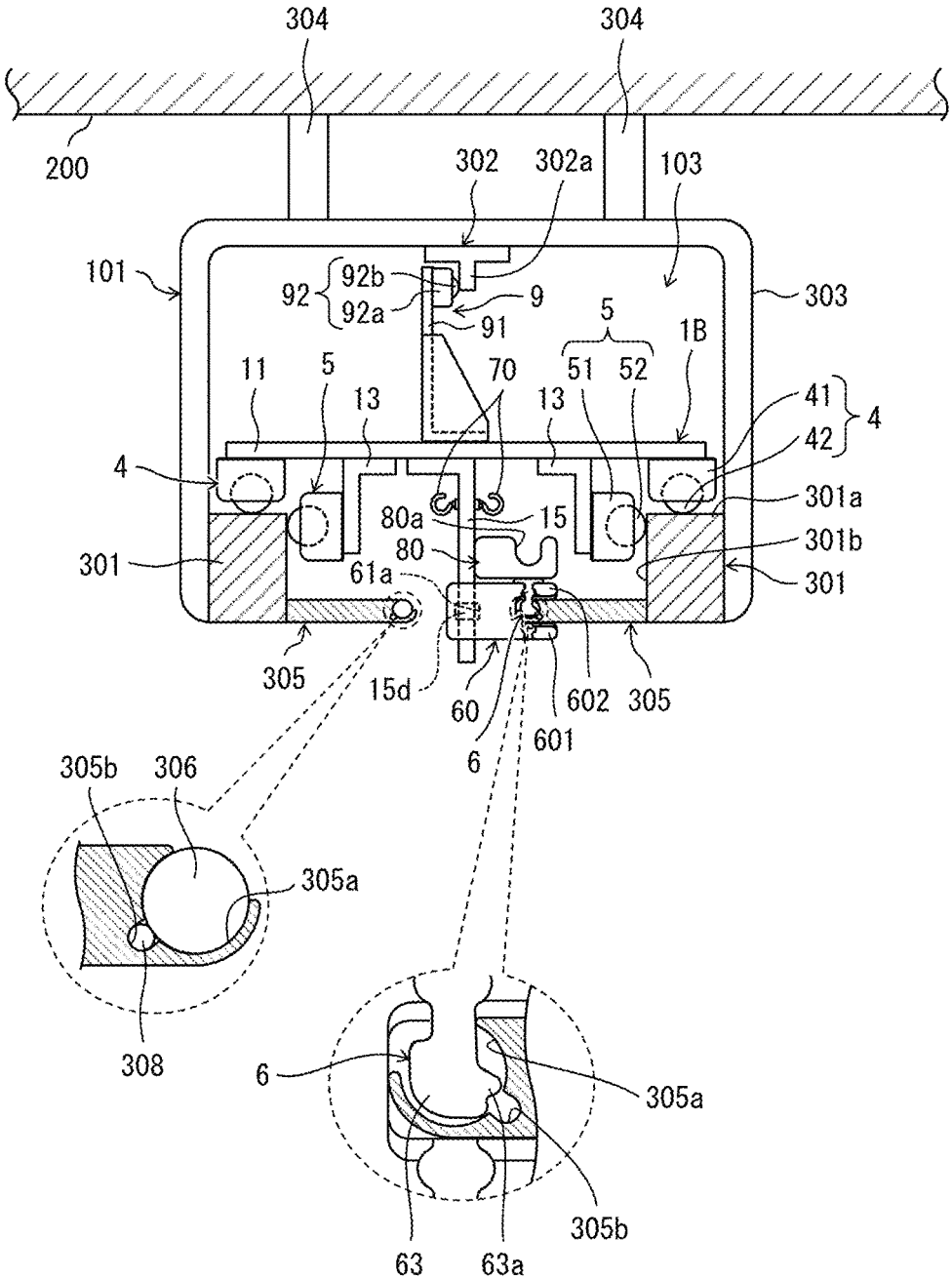
FIG. 17 is a front view illustrating a state in which an installation tool in accordance with Embodiment 3 of the present invention is placed on the rails in the above-described transport system.
Figure 18:
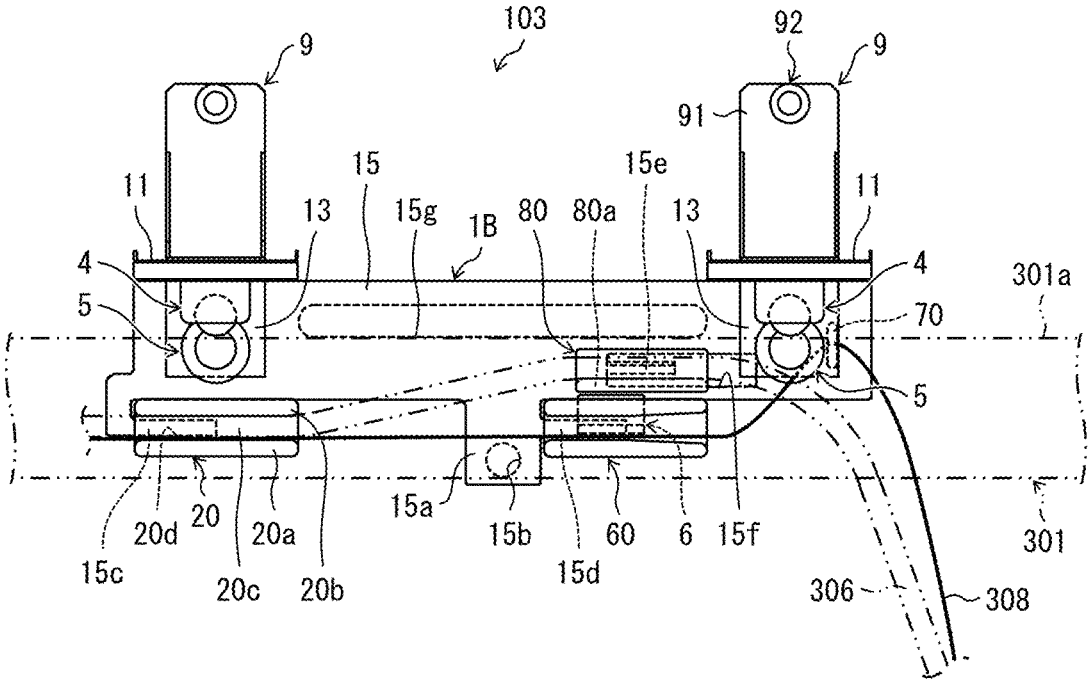
FIG. 18 is a side view illustrating the configuration of the installation tool illustrated in FIG. 17.
Figure 19:
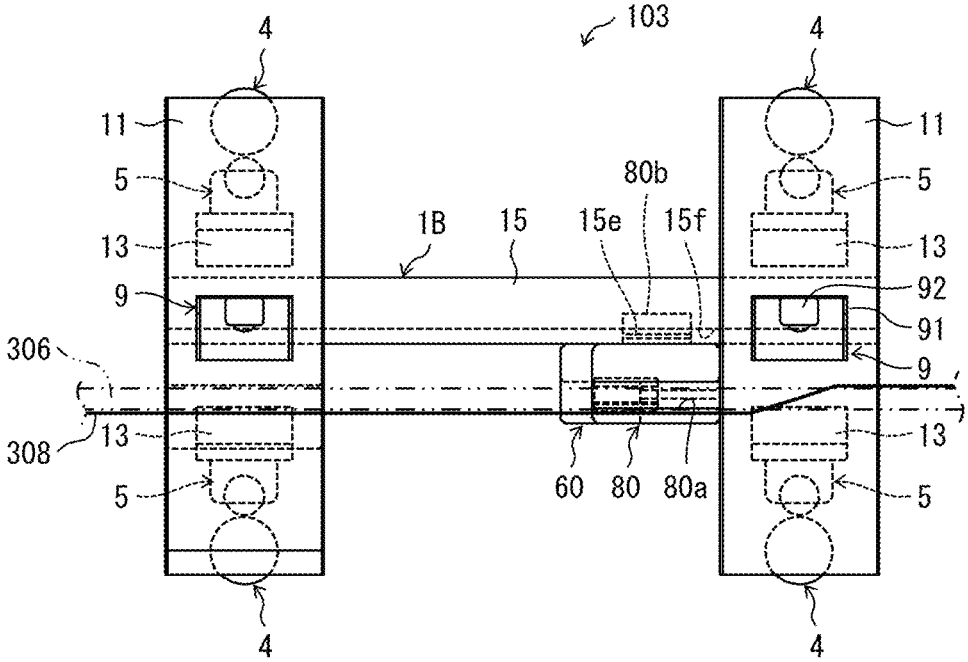
FIG. 19 is a plan view illustrating the configuration of the installation tool illustrated in FIG. 17.
Figure 20:
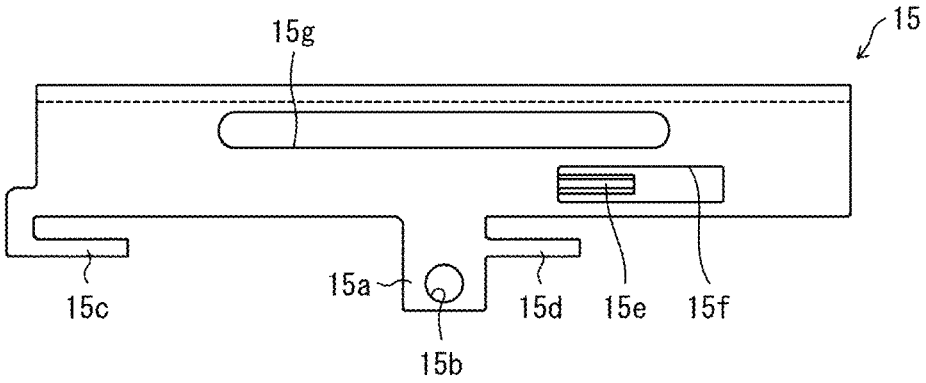
FIG. 20 is a side view illustrating the configuration of a base body part in the installation tool illustrated in FIG. 17.
Figure 21:
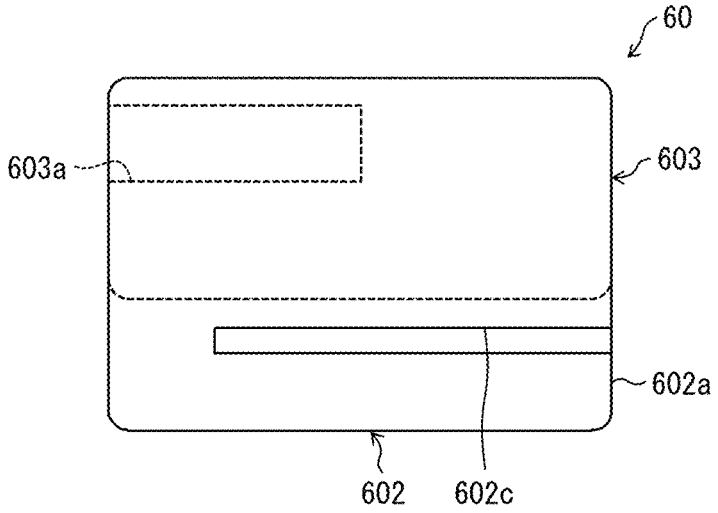
FIG. 21 is a plan view illustrating the configuration of a pressing support part which is mounted in the installation tool illustrated in FIG. 17.
Figure 22:
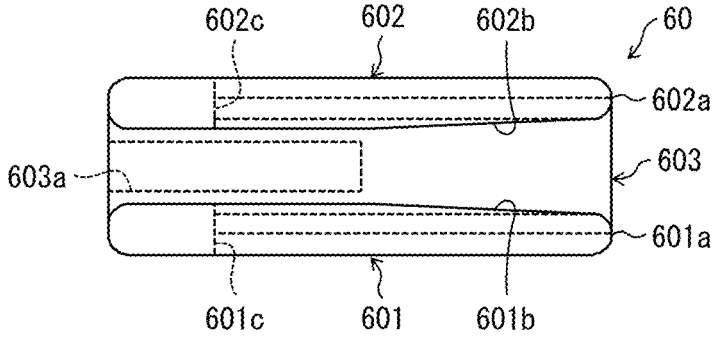
FIG. 22 is a front view illustrating the configuration of the pressing support part illustrated in FIG. 21.
Figure 23:
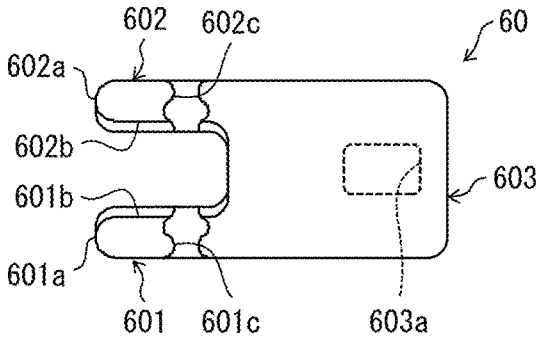
FIG. 23 is a side view illustrating the configuration of the pressing support part.
Figure 24:
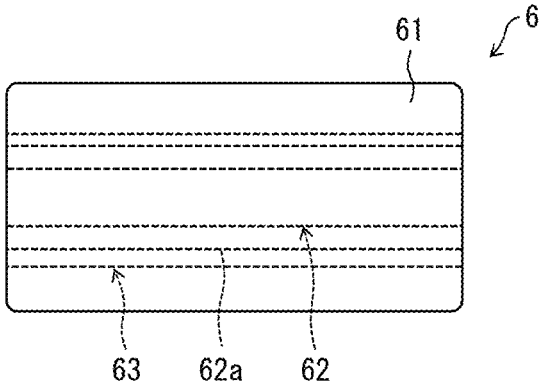
FIG. 24 is a plan view illustrating the configuration of a pressing part which is fitted into the pressing support part.
Figure 25:
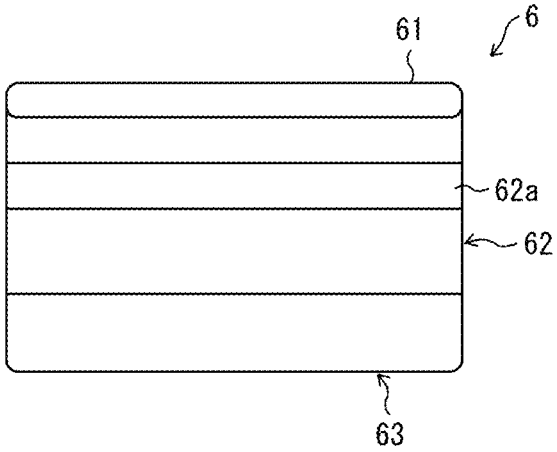
FIG. 25 is a front view illustrating the configuration of the pressing part.
Figure 26:
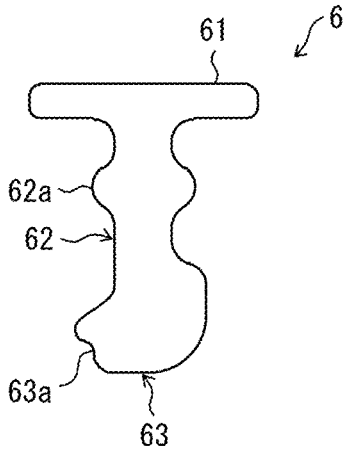
FIG. 26 is a side view illustrating the configuration of the pressing part.

FIG. 17 is a front view illustrating a state in which an installation tool 103 in accordance with Embodiment 3 of the present invention is placed on the rails 301 in the transport system. FIG. 18 is a side view illustrating the configuration of the installation tool 103. FIG. 19 is a plan view illustrating the configuration of the installation tool 103. FIG. 20 is a side view illustrating the configuration of a base body part 15 in the installation tool 103. FIG. 21 is a plan view illustrating the configuration of a pressing support part 60 which is mounted in the installation tool 103. FIG. 22 is a front view illustrating the configuration of the pressing support part 60. FIG. 23 is a side view illustrating the configuration of the pressing support part 60. FIG. 24 is a plan view illustrating the configuration of a sub-pressing part 6 which is fitted into the pressing support part 60. FIG. 25 is a front view illustrating the configuration of the sub-pressing part 6. FIG. 26 is a side view illustrating the configuration of the sub-pressing part 6.

As illustrated in FIGS. 17 to 19, the installation tool 103 has a main body part 1B, a plurality of moving and rolling parts 4, a plurality of regulating and rolling parts 5, a sub-pressing part 6, a pair of displacement regulating parts 9, a pressing part 20, a pressing support part 60, and a support part 80. The installation tool 103 is moved on the rails 301 by a worker pulling on a rope, as will be described later. Therefore, the installation tool 103, like the installation tool 101, is preferably lightweight and is formed of, for example, resin.

The installation tool 103 not only installs the feed line 306 in the feed line holder 305, but also installs a heat detection line 308 (detection line) in the feed line holder 305. The heat detection line 308 has the function of detecting an overheating state of the feed line 306. Specifically, the heat detection line 308 is formed of copper or the like so as to be, when the feed line 306 becomes heated to a temperature not lower than a predetermined temperature, fused by heat of the feed line 306. In a case where the feed line 306 has become overheated due to miswiring or the like of the feed line 306, the heat detection line 308 is broken. This stops the feeding of power to the feed line 306.

Note that the feed line 306 in Embodiments 1 and 2 may have a heat detection line having the same function as the heat detection line 308 incorporated into a coating of the feed line 306.

The feed line holder 305 has a holding part 305*a* and a sub-holding part 305*b*. The sub-holding part 305*b* holds the heat detection line 308 at a position where the heat detection line 308 contacts the feed line 306 in the feed line holder 305, and is provided so as to be continuous with the holding part 305*a*.

The main body part 1B has movement support parts 11, rolling leg parts 13, and a base body part 15 so as to be capable of moving along the rails 301.

The base body part 15 constitutes a basic structure of the main body part 1B by having an upper end surface which is fixed, at opposite end portions thereof, on corresponding lower surfaces of the pair of movement support parts 11. The base body part 15 is disposed so as to be suspended with respect to the movement support parts 11. The base body part 15 is formed to be shorter than the base body part 12 of the installation tool 101 in Embodiment 1 because a place at which the pressing part 20 is mounted (described later) is limited to one place.

As illustrated in FIG. 20, the base body part 15 has a suspended part 15*a* and a hole 15*b* (hanging structure). The suspended part 15*a* is a part that constitutes a rectangle which is formed so as to be suspended downward from a lower end of a substantially central portion of the base body part 15.

The hole 15*b* is formed in the suspended part 15*a*. The hole 15*b* is provided to allow a rope for moving the main body part 1B to be drawn therethrough and hung when the feed line 306 and the heat detection line 308 are installed in the feed line holder 305. The hole 15*b* is provided in an area defined between the moving and rolling part 4 which is provided at a front end portion of the main body part 1B in the direction in which the main body part 1B is moved (right direction in FIG. 18; hereinafter referred to simply as "movement direction") and the moving and rolling part 4 which is provided at a rear end portion of the main body part 1B in the movement direction. Further, the hole 15*b* is provided at a position that allows the rope to be hung at a position lower than a lower end of the sub-pressing part 6.

Note that the hanging structure is not limited to the hole 15*b*, and may be a structure such as a hook, provided that the hanging structure is a structure that allows the rope to be hung.

The base body part 15 has support rods 15*c*, 15*d*, and 15*e*. The support rods 15*c*, 15*d*, and 15*e* are provided for allowing the pressing part 20, the pressing support part 60, and the support part 80, respectively, to be removably mounted on the base body part 15.

The support rod 15*c* is provided in an end portion of the base body part 15 where the pressing part 20 is to be mounted. Specifically, the support rod 15*c* is provided in a lower portion of a rear end of the base body part 15 in the movement direction. The support rod 15*c* is formed so as to have (i) a portion extending downward and protruding rearward from the rear end of the base body part 15 and (ii) a portion extending from a lower end of the portion (i) toward the movement direction.

The support rod 15*d* is provided in a front end of the suspended part 15*a* in the movement direction at a position somewhat higher than the hole 15*b*. Further, the support rod 15*d* is formed so as to extend in the same direction as the direction in which the support rod 15*c* extends.

The support rod 15*e* is provided in a long hole 15*f* that is formed in the base body part 15. The long hole 15*f* is formed on a side further frontward than the front end of the suspended part 15*a* in the movement direction so as to extend in the same direction as the direction in which the support rod 15*c* extends. The support rod 15*e* is formed so as to extend, from a rear end of the long hole 15*f* in the movement direction, in the same direction as the direction in which the support rod 15*c* extends. Further, the support rod 15*e* has a length shorter than the length of the long hole 15*f*. For example, the support rod 15*e* has a length shorter than half the length of the long hole 15*f*.

The pressing part 20 is configured to move together with the main body part 1B along the rails 301 and continuously press the feed line 306 into the holding part 305*a* of the feed line holder 305 as the main body part 1B is moved. The pressing part 20 is disposed on one end portion of one of opposite surfaces of the base body part 15. Specifically, the pressing part 20 is disposed on a rear end portion of the base body part 15 in the movement direction. Specifically, the pressing part 20 is removably mounted to the main body part 1B by inserting the support rod 15*c* into the pressing part 20. Like the pressing part 2 in the installation tool 102 in Embodiment 1, the pressing part 20 is formed of a material having a small friction coefficient.

The pressing part 20 has a lower portion 20*a*, an upper portion 20*b* (abutting portion), a mounting portion 20*c*, and an insertion hole 20*d*. The lower portion 20*a*, the upper portion 20*b*, and the mounting portion 20*c* have substantially the same structure as the lower portion 2*a*, the upper portion 2*b*, and the mounting portion 2*c* of the pressing part 2 in the installation tool 101 described above.

The insertion hole 20*d* is provided for inserting the support rod 15*c* thereinto. The insertion hole 20*d* is formed so as to open in a rear end surface of the mounting portion 20*c* and extend to a substantially central portion of the mounting portion 20*c* in the movement direction. In other words, the rear end surface of the mounting portion 20*c* is a surface on a side where the feed line 306 passing through between the lower portion 20*a* and the upper portion 20*b* exits from the pressing part 20 when the pressing part 20 is moved.

The support part 80 supports the feed line 306 which is to be introduced into the pressing part 20. The support part 80 is mounted on the base body part 15 so as to move together with the main body part 1B along the rails 301. The support part 80 is disposed at a position that is slightly forward of the center of the base body part 15 so as to be positioned forward of the pressing part 20 in the movement direction and that is higher than the pressing part 20. Further, the support part 80 is formed so as to extend in the lengthwise direction of the base body part 15 and has a groove 80*a* that guides the feed line 306.

As illustrated in FIG. 19, the support part 80 has a mounting portion 80*b*. The mounting portion 80*b* is provided on a side surface of the support part 80 facing the base body part 15 along the groove 80*a* so as to protrude through the side surface of the support part 80. Although not illustrated, the mounting portion 80*b* has an insertion hole that extends in the same direction as the direction in which the groove 80*a* extends. The mounting portion 80*b* is supported by the base body part 15 by being inserted into the long hole 15*f* so as to pass through the long hole 15*f* and by causing the support rod 15*e* to be inserted into the insertion hole of the mounting portion 80*b*. In this way, the support part 80 is removably mounted to the main body part 1B by inserting the support rod 15*e* into the support part 80.

The base body part 15 has a long hole 15*g*. The long hole 15*g* is provided near an upper end of the base body part 15 at a position higher than the long hole 15*f*. Further, the long hole 15*g* is formed so as to extend from the center of the base body part 15 such that a length extending frontward of the center of the base body part 15 in the movement direction is substantially equal to a length extending rearward thereof. The long hole 15*g* is provided for achieving light weight of the base body part 15 and for allowing the worker to easily hold the main body part 1B.

The sub-pressing part 6 moves together with the main body part 1B along the rails 301 and is positioned forward of the pressing part 20 in the movement direction. The sub-pressing part 6 continuously presses the heat detection line 308 into the sub-holding part 305*b* as the main body part 1B is moved. As illustrated in an enlarged view in FIG. 17, the sub-pressing part 6 has a leading end portion 63 that moves within the holding part 305*a* and introduces the heat detection line 308 into the sub-holding part 305*b*. The sub-pressing part 6 will be described in detail later.

The pressing support part 60 supports the sub-pressing part 6 in such a manner as to allow the leading end portion 63 to move within the holding part 305*a* and to allow the sub-pressing part 6 to be removed from the main body part 1B. As illustrated in FIGS. 21 to 23, the pressing support part 60 has a lower portion 601 (protrusion), an upper portion 602 (protrusion), and a mounting portion 603.

The lower portion 601 is formed so as to face a lower surface of the feed line holder 305 in a state in which the installation tool 103 is placed on the rails 301. The upper portion 602 is formed so as to face the lower portion 601 with an interval which is provided between the upper portion 602 and the lower portion 601 and which is slightly wider than the thickness of the feed line holder 305. The lower portion 601 and the upper portion 602 have, on sides thereof where the heat detection line 308 is to be introduced, an introduction end portion 601*a* and an introduction end portion 602*a*, respectively.

Note that the lower portion 601 and the upper portion 602 change their positions depending on a direction of mounting of the pressing support part 60 to the base body part 15. Specifically, as illustrated in FIG. 17, the lower portion 601 and the upper portion 602 change their positions depending on whether the pressing support part 60 is in a state of being mounted to the right of the base body part 15 or in a state of being mounted to the left thereof when viewed from the front in a direction in which the installation tool 103 is headed. This is made for the purpose of preventing the orientation of an insertion hole 603*a* described later from being changed.

The mounting portion 603 is a portion that is to be mounted on the base body part 15, and is connected to one end edge of the lower portion 601 and one end edge of the upper portion 602. The mounting portion 603 has an insertion hole 603*a*. The insertion hole 603*a* is provided for inserting the support rod 15*d* thereinto. The insertion hole 603*a* is formed so as to open in a rear end surface of the mounting portion 603 and extend to a substantially central portion of the mounting portion 603 in the movement direction (right direction in FIG. 21). In other words, the rear end surface of the mounting portion 603 is a surface on a side where the heat detection line 308 passing through between the lower portion 601 and the upper portion 602 exits from the pressing support part 60 when the pressing support part 60 is moved.

With the structure as described above, the lower portion 601 and the upper portion 602, which constitute a pair of protrusions, are disposed so as to cover the holding part 305*a* together with the mounting portion 603 and to protrude above and below the feed line holder 305 from the mounting portion 603. In addition, the lower portion 601 and the upper portion 602 have an inclined portion 601*b* and an inclined portion 602*b*, respectively. The inclined portions 601*b* and 602*b* are inclined such that an interval between the lower portion 601 and the upper portion 602 decreases with increasing distance from the introduction end portions 601*a* and 602*a* to positions at or near centers of the lower portion 601 and of the upper portion 602 in the movement direction.

The feed line holder 305 is constituted by a plurality of components having a predetermined length, and is formed by, during attachment of the components to the rail 301, sequentially connecting the components to the lengthwise side of the rail 301. In a case where some of the components are not properly attached to the rail 301, a level difference at a joint between the components may be caused in the feed line holder 305. In such a case, for example, a problem is likely to occur that the lower portion 601 and the upper portion 602 of the pressing support part 60 get stuck with the level difference.

As a countermeasure against this problem, the lower portion 601 and the upper portion 602 have the inclined portion 601*b* and the inclined portion 602*b*, respectively, so that a wide interval between the lower portion 601 and the upper portion 602 is secured at the respective introduction end portions 601*a* and 602*a*. Even when the level difference is caused in the feed line holder 305, this configuration allows the lower portion 601 and the upper portion 602 to be less likely to get stuck with the level difference. Therefore, with small influence of the level difference, it is possible to stably introduce and press the heat detection line 308.

Note that the lower portion 20*a* and the upper portion 20*b* of the above-described pressing part 20 may also have respective inclined portions of the same structure as the inclined portions 601*b* and 602*b*. Further, the pressing parts 2 and 7 in Embodiments 1 and 2 may also have respective inclined portions of the same structure as the inclined portions 601*b* and 602*b*.

The lower portion 601 and the upper portion 602 have a slit 601*c* and a slit 602*c*, respectively. The slits 601*c* and 602*c* are provided for fitting the sub-pressing part 6 into the pressing support part 60. The slit 601*c* is formed so as to extend from the introduction end portion 601*a* to a position near a rear end of the slit 601*c* in a direction opposite to the movement direction (right direction in FIG. 22). The slit 602*c* is formed so as to extend from the introduction end portion 602*a* to a position near a rear end of the slit 602*c* in the direction opposite to the movement direction. The slits 601*c* and 602*c* are formed so as to have respective vertical midsections which are larger in width than the other sections of the slits 601*c* and 602*c*.

As illustrated in FIGS. 24 to 26, the sub-pressing part 6 has a top portion 61, a middle portion 62, and a leading end portion 63.

The top portion 61 is formed in a rectangular plate shape. The middle portion 62 is formed on a lower end surface of the top portion 61 and at the center of the top portion 61 in a width direction so as be suspended from the lower end surface of the top portion 61 throughout the length of the top portion 61. The middle portion 62 has a wide portion 62*a*. The wide portion 62*a* is provided approximately at a mid-section of the middle portion 62 and is formed so as to be curved and wider than the other sections. The above-described slits 601*c* and 602*c* are formed so as to conform to the outer shape of the middle portion 62 so that the middle portion 62 is fitted into the slits 601*c* and 602*c*.

The leading end portion 63 is formed throughout the length of the top portion 61 so as to follow the lower end of the middle portion 62. The leading end portion 63 has a tip-split portion 63*a*. The tip-split portion 63*a* is provided on one side in a width direction of the top portion 61. The tip-split portion 63*a* is formed so as to have a two-pronged tip.

With regard to the sub-pressing part 6 configured as described above, an upper end of the top portion 61 sits on an upper end surface of the upper portion 602 of the pressing support part 60, and the middle portion 62 is inserted into the slit 602*c*. Further, while the pressing support part 60 moves, the sub-pressing part 6 is held by a rear end of the slit 602*c*, and the wide portion 62*a* of the middle portion 62 is held by being fitted into the slit 602*c*. Thus, the sub-pressing part 6 does not come out of the slit 602*c* during the movement of the installation tool 103. Further, as illustrated in FIG. 17, the sub-pressing part 6 is disposed such that the tip-split portion 63*a* blocks the sub-holding part 305*b*. Thus, by moving together with the pressing support part 60, the sub-pressing part 6 can press the heat detection line 308 into the sub-holding part 305*b* with the tip-split portion 63*a* pressed against the heat detection line 308.

<Method for Installing Feed Line with Use of Installation Tool>

Figure 27:
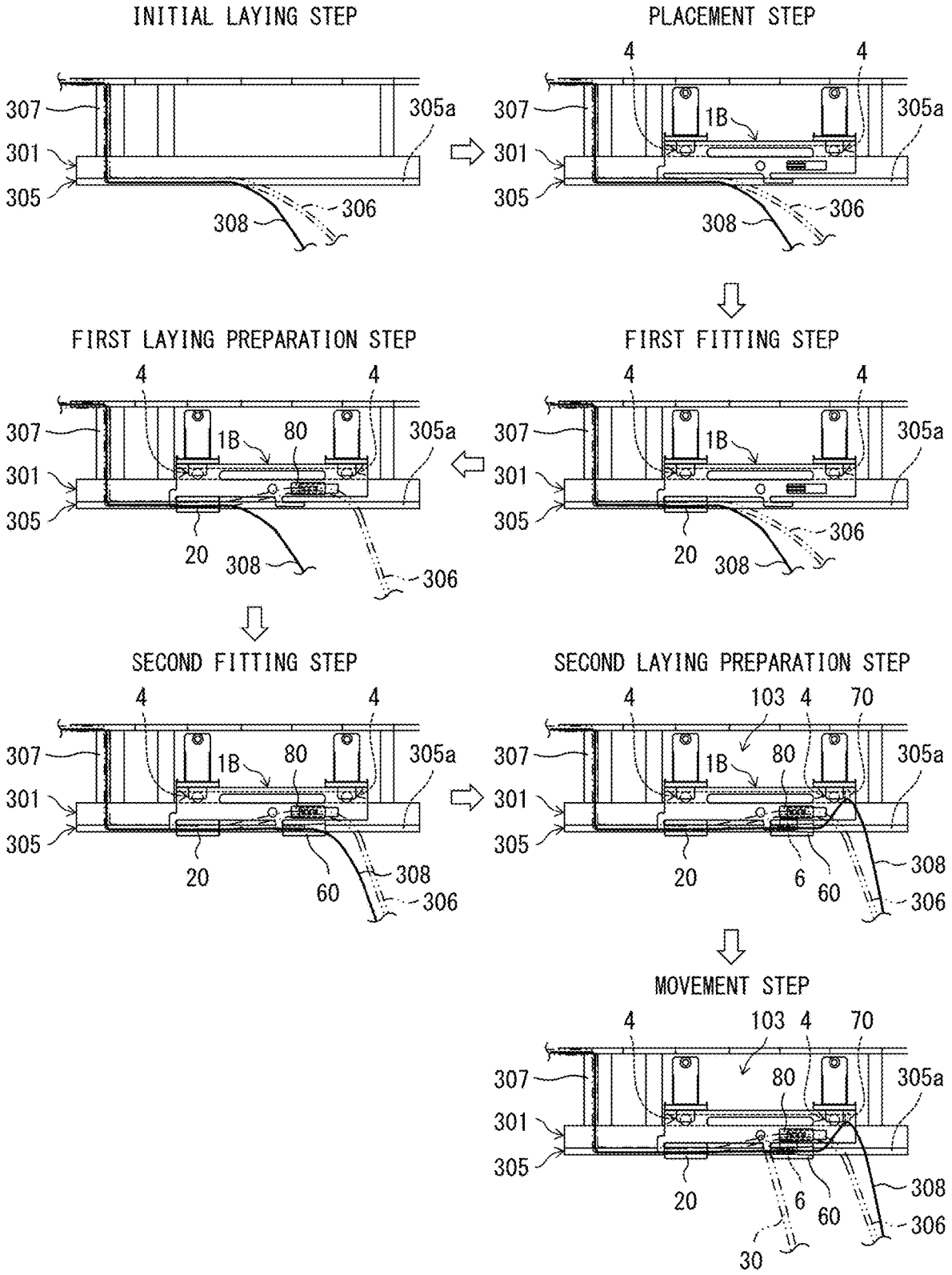
FIG. 27 is a view illustrating steps for the installation of the feed line and a heat detection line in the feed line holder with use of the installation tool illustrated in FIG. 17.

FIG. 27 is a view illustrating steps for the installation of the feed line 306 and the heat detection line 308 in the feed line holder with use of the installation tool 103.

As illustrated in FIG. 27, first, a worker, on a platform, forces, into the holding part 305*a* of the feed line holder 305, a part of the feed line 306 having been drawn out from a draw-out part 307 for the feed line 306 and a part of the heat detection line 308 having been drawn out from the draw-out part 307 for the feed line 306 by pressing the part of the feed line 306 and the part of the heat detection line 308 respectively into the holding part 305*a* and the sub-holding part 305*b* of the feed line holder 305 (initial laying step). Next, the worker places the main body part 1B on the rails 301 (placement step).

Then, the worker fits the pressing part 20 to an end portion of the feed line holder 305 into which the feed line 306 has been forced, so that the pressing part 20 is inserted into the feed line holder 305 (first fitting step). In the first fitting step, as illustrated in FIG. 18, the worker mounts the pressing part 20 to the main body part 1B by inserting the pressing part 20 into the feed line holder 305 and then moving the pressing part 20 rearward so that the support rod 15*c* of the base body part 15 is inserted into the pressing part 20.

Thus, when the main body part 1B moves on the rails 301, the pressing part 20 receives resistance due to contact with the feed line 306, so that the support rod 15*c* prevents the pressing part 20 from moving toward the rear of the installation tool 103. Therefore, the pressing part 20 does not come off from the base body part 15. Hence, the pressing part 20 can be easily mounted to the main body part 1B (base body part 15) without using screws.

After that, the worker lifts the feed line 306 jutting out of the pressing part 20 and places the feed line 306 in the groove of the support part 80 (first laying preparation step). In the first laying preparation step, as illustrated in FIG. 18, the worker mounts the support part 80 to the main body part 1B by inserting the support rod 15*e* of the base body part 15 into the support part 80.

Then, the worker presses the heat detection line 308 into the sub-holding part 305*b* to a position at which the sub-pressing part 6 is to be mounted to the main body part 1B, and the worker fits the pressing support part 60 into the feed line holder 305, at the position at which the heat detection line 308 has been pressed into the sub-holding part 305*b*, so that the pressing support part 60 is inserted into the feed line holder 305 (second fitting step). In the second fitting step, as illustrated in FIG. 18, the worker mounts the pressing support part 60 to the main body part 1B by inserting the pressing support part 60 into the feed line holder 305 and then moving the pressing support part 60 rearward so that the support rod 15*d* of the base body part 15 is inserted into the pressing support part 60.

Furthermore, the worker places the sub-pressing part 6 such that the tip-split portion 63*a* of the leading end portion 63 presses the heat detection line 308 which is placed inside the sub-holding part 305*b*. In this state, the worker fits the sub-pressing part 6 into the slit 602*c* of the pressing support part 60 and moves the sub-pressing part 6 rearward so that the sub-pressing part 6 is mounted in the pressing support part 60 (second laying preparation step (post-fitting step)). In the second laying preparation step, the worker hangs the heat detection line 308 on a hook 70 at a section forward of the pressing support part 60.

In this way, the pressing part 20, the support part 80, the pressing support part 60, and the sub-pressing part 6 are mounted to the main body part 1B. This completes the installation tool 103. In this state, the worker causes the rope 30 to be hung down from the hole 15*b* of the base body part 15. Then, a worker who has waited below moves the installation tool 103 along the rails 301 by pulling on the rope 30 in front of the installation tool 103 in the direction in which the installation tool 103 is moved (movement step).

With the movement of the installation tool 103, as the pressing part 20 is moved, the upper portion 20*b* abuts, from above, on the feed line 306 which is to be introduced into the pressing part 20. Thus, the feed line 306 is pressed downward into the holding part 305*a* which is open in the upper portion thereof.

Further, as the pressing support part 60 is moved, the tip-split portion 63*a* of the sub-pressing part 6 is pressed against the heat detection line 308 which is placed inside the holding part 305*a* of the feed line holder 305, so that the heat detection line 308 is introduced into the sub-holding part 305*b*. This causes the heat detection line 308 to be pressed into the sub-holding part 305*b* which is continuous with the holding part 305*a*.

During the movement of the installation tool 103, the hook 70 supports, at a position higher than the pressing support part 60, the heat detection line 308 which is to be introduced into the pressing support part 60. This makes it possible to reduce the load applied to the pressing support part 60, as compared with the structure in which the heat detection line 308 hanging downward is directly introduced into the pressing support part 60. Consequently, the heat detection line 308 is easily introduced into the pressing support part 60.

Thus, moving the installation tool 103 makes it possible to install the feed line 306 and the heat detection line 308 in the feed line holder 305. Therefore, it is possible to reduce the work of the worker pressing the feed line 306 and the heat detection line 308 into the feed line holder 305.

Aspects of the present invention can also be expressed as follows:

As described above, an installation tool in accordance with Aspect 1 of the present invention is an installation tool for installing a feed line in a feed line holder, the feed line holder accompanying any of rails for allowing a carrier to travel thereon and holding the feed line, the feed line feeding electric power to the carrier in a non-contact manner, the installation tool including: a main body part configured to be capable of moving along the rails; and a pressing part configured to move together with the main body part along the rails and continuously press the feed line into a holding part of the feed line holder as the main body part is moved, the holding part being partially open.

According to the above-described configuration, as the main body part is moved, the feed line is pressed into the feed line holder by the pressing part. Consequently, it is possible to reduce the work of the worker pressing the feed line into the feed line holder.

An installation tool in accordance with Aspect 2 of the present invention is configured, in Aspect 1 above, such that the holding part is open at an upper portion thereof, and the pressing part has an abutting portion that, by being placed in a vicinity of a top of the feed line holder, abuts, from above, on the feed line which is to be introduced into the pressing part as the pressing part is moved.

According to the above-described configuration, the abutting portion abuts on the feed line from above. Thus, it is possible to press the feed line downward into the holding part which is open in the upper portion thereof.

An installation tool in accordance with Aspect 3 of the present invention is configured, in Aspect 1 or 2 above, to further include a support part configured to move together with the main body part along the rails and support the feed line which is to be introduced into the pressing part, the support part being disposed forward of the pressing part in a direction in which the main body part is moved and being disposed at a position higher than the pressing part.

According to the above-described configuration, the feed line which is to be introduced into the pressing part is supported at a position higher than the pressing part. Thus, it is possible to reduce the load applied to the pressing part, as compared with the structure in which the feed line hanging downward is directly introduced into the pressing part. Consequently, the feed line is easily introduced into the pressing part.

An installation tool in accordance with Aspect 4 of the present invention is configured, in Aspect 3 above, such that the support part has a groove that guides the feed line.

According to the above-described configuration, it is possible to support the feed line by placing the feed line in the groove of the support part. Consequently, it is possible to easily conduct work for allowing the support part to support the feed line.

An installation tool in accordance with Aspect 5 of the present invention is configured, in Aspect 1 to further include a sub-pressing part configured to move together with the main body part along the rails and continuously press a detection line into a sub-holding part as the main body part is moved, the sub-pressing part being disposed forward of the pressing part in a direction in which the main body part is moved, the detection line being configured to detect an overheating state of the feed line, the sub-holding part being configured to hold the detection line at a position where the detection line contacts the feed line in the feed line holder and being provided so as to be continuous with the holding part.

According to the above-described configuration, as the main body part is moved, the detection line is pressed into the sub-holding part by the sub-pressing part before the feed line is pressed into the holding part. Consequently, it is possible to reduce the work of the worker pressing the detection line into the feed line holder.

An installation tool in accordance with Aspect 6 of the present invention is configured, in Aspect 5, such that the sub-pressing part has a leading end portion that moves within the holding part and introduces the detection line into the sub-holding part. In addition, the installation tool further comprises a pressing support part configured to support the sub-pressing part in such a manner as to allow the leading end portion to move within the holding part and to allow the sub-pressing part to be removed from the main body part.

According to the above-described configuration, the detection line, which is generally formed so as to be thinner than the feed line, in a state of being drawn into the holding part is introduced into the sub-holding part by the leading end portion that moves within the holding part. This causes the detection line to be pressed into the sub-holding part. Further, the sub-pressing part is supported by the pressing support part in such a manner as to allow the sub-pressing part to be removed from the main body part. This allows the worker to conduct initial work of pressing the detection line into the sub-holding part and then mount the sub-pressing part to the main body part with the leading end portion pressed against the detection line. Consequently, it is possible to easily conduct the above-described initial work.

An installation tool in accordance with Aspect 7 of the present invention is configured, in Aspect 6, such that the main body part has a base body part that constitutes a basic structure of the main body part, and the pressing support part has: a mounting portion that is mounted to the base body part; and a pair of protrusions that are disposed so as to cover the holding part together with the mounting portion and to protrude above and below the feed line holder from the mounting portion, the pair of protrusions having respective inclined portions that are inclined such that an interval between the pair of protrusions decreases with increasing distance from introduction end portions which are provided on a side where the detection line is to be introduced to a rear side in a direction in which the main body part is moved.

According to the above-described configuration, the pair of protrusions have respective inclined portions, so that a wide interval between the pair of protrusions is secured at the introduction end portions. Even when the level difference is caused in the feed line holder at a section where the components which constitute the feed line holder are joined, this configuration allows the pair of protrusions to be less likely to get stuck with the level difference. Therefore, with small influence of the level difference, it is possible to stably introduce and press the detection line.

An installation tool in accordance with Aspect 8 of the present invention is configured, in Aspect 5 or 6, such that the main body part has a hanging structure for hanging a rope at a position lower than a lower end of the sub-pressing part.

According to the above-described configuration, it is possible to avoid the rope from coming into contact with the sub-pressing part. Thus, it is possible to move the main body part smoothly by pulling on the rope.

An installation tool in accordance with Aspect 9 of the present invention is configured, in any one of Aspects 1 to 8 above, such that the pressing part is disposed on a rear end portion of the main body part in a direction in which the main body part is moved.

According to the above-described configuration, it is possible to shorten the total length of the main body part in the direction in which the main body part is moved.

An installation tool in accordance with Aspect 10 of the present invention is configured, in any one of Aspects 1 to 4 above, such that the main body part has notches that are formed so as to extend along a direction in which the main body part is moved, and the pressing part has hook-like engagement portions that are engaged in the notches.

According to the above-described configuration, it is possible to easily join the pressing part to the main body part without using screws. Further, by moving the installation tool in the direction of forward movement, a force is applied in a direction in which the engagement portions are more deeply engaged in the notches. Consequently, it is possible to reduce the tendency of the pressing part to come off from the main body part without the need to secure the pressing part to the main body part by screws or the like.

An installation tool in accordance with Aspect 11 of the present invention is configured, in any one of Aspects 1 to 8 above, to further include a maintaining part configured to maintain a posture of the main body part by abutting on an upper rail that is provided above the rails and that is for guiding the carrier.

An installation tool in accordance with Aspect 12 of the present invention is configured, in any one of Aspects 1 to 7 above, to further include rolling parts configured to roll on the rails to move the main body part.

According to the above-described configuration, the main body part can smoothly move on the rails.

An installation tool in accordance with Aspect 13 of the present invention is configured, in Aspect 12 above, such that the rolling parts are provided at a front end portion of the main body part and at a rear end portion thereof in a direction in which the main body part is moved, the main body part has a hanging structure for hanging a rope, and the hanging structure is provided in an area defined between the rolling part provided at the front end portion of the main body part and the rolling part provided at the rear end portion of the main body part.

According to the above-described configuration, it is possible to move the main body part on the rails by pulling the main body part in the direction of movement from below the main body part by the rope. Further, the moment of the entire installation tool is easily balanced by an upward reaction force received by the rolling part from the rail and a force acting diagonally downward through the rope. Thus, it is possible to stably pull the main body part.

An installation method in accordance with Aspect 14 of the present invention is an installation method for installing a feed line in a feed line holder, the feed line holder accompanying any of rails for allowing a carrier to travel thereon and holding the feed line, the feed line feeding electric power to the carrier in a non-contact manner, the installation method including: a fitting step of fitting, to the feed line holder having a holding part which is partially open, a pressing part configured to press the feed line into the holding part as the pressing part is moved; and a movement step of moving the pressing part along the rails.

According to the above-described method, as the pressing part is moved, the feed line is pressed into the feed line holder by the pressing part. Consequently, it is possible to reduce the work of the worker pressing the feed line into the feed line holder.

An installation method in accordance with Aspect 15 of the present invention, in the movement step in Aspect 14 above, further includes a mounting step of, prior to the movement step, placing, on the rails, a main body part configured to be capable of moving along the rails and mounting, on the main body part, the pressing part having been fitted to the feed line holder.

According to the above-described method, it is possible to move the pressing part at a position away from the pressing part. Consequently, it is possible to greatly reduce work at a high place.

An installation method in accordance with Aspect 16 of the present invention, in Aspect 14 above, further includes a post-fitting step of fitting a sub-pressing part into a pressing support part, the sub-pressing part being configured to press a detection line into a sub-holding part as the sub-pressing part is moved, the pressing support part being configured to support the sub-pressing part in such a manner as to allow the sub-pressing part to be removed from a main body part configured to be capable of moving along the rails, the detection line being configured to detect an overheating state of the feed line, the sub-holding part being configured to hold the detection line at a position where the detection line contacts the feed line in the feed line holder and being provided so as to be continuous with the holding part, wherein in the movement step, the sub-pressing part is moved together with the pressing part.

According to the above-described method, as the main body part is moved, the detection line is pressed into the sub-holding part by the sub-pressing part before the feed line is pressed into the holding part. Consequently, it is possible to reduce the work of the worker pressing the detection line into the feed line holder.

An installation method in accordance with Aspect 17 of the present invention is such that, in the movement step in any of Aspects 14 to 16 above, the pressing part is moved by pulling on a rope.

According to the above-described method, it is possible to move the pressing part at a position away from the pressing part. Consequently, it is possible to greatly reduce work at a high place.

ADDITIONAL REMARKS

The present invention is not limited to the above-described embodiments, but can be altered in various ways by a skilled person in the art within the scope of the claims. The present invention also encompasses, in its technical scope, any embodiment derived by combining technical means disclosed in differing embodiments.

REFERENCE SIGNS LIST

1, 1A, 1B main body part
2, 7 pressing part
6 sub-pressing part
2*b*, 7*b*, 20*b* upper portion (abutting portion)
7*d* engagement portion
3, 8, 80 support part
4 moving and rolling part (rolling part)
5 regulating and rolling part (rolling part)
8*a*, 80*a* groove
9 displacement regulating part (maintaining part)
12*a*, 14*a*, 15*b* hole (hanging structure)
14*b* notch
60 pressing support part
101, 102, 103 installation tool
301 rail
305 feed line holder
305*a* holding part
305*b* sub-holding part
306 feed line
308 heat detection line (detection line)
601 lower portion (protrusion)
601*a*, 602*a* introduction end portion
601*b*, 602*b* inclined portion
602 upper portion (protrusion)
603 mounting portion

The invention claimed is:

1. An installation tool for installing a feed line in a feed line holder, the feed line holder accompanying rails for allowing a carrier to travel thereon and holding the feed line, the feed line feeding electric power to the carrier in a non-contact manner, the installation tool comprising:
- a main body configured to be capable of moving along the rails; and
- a pressing member configured to move together with the main body along the rails and continuously press the feed line into a holding structure of the feed line holder, as the main body is moved, the holding structure being partially open.

2. The installation tool according to claim 1, wherein the pressing member is disposed on a rear end portion of the main body in a direction in which the main body is moved.

3. The installation tool according to claim 1, wherein
- the main body has notches that are formed so as to extend along a direction in which the main body is moved, and
- the pressing member has hook-like engagement portions that are engaged in the notches.

4. The installation tool according to claim 1, further comprising a maintaining part configured to maintain a posture of the main body by abutting on an upper rail that is provided above the rails and that is for guiding the carrier.

5. The installation tool according to claim 1, further comprising rolling parts configured to roll on the rails to move the main body.

6. The installation tool according to claim 5, wherein
- the rolling parts are provided at a front end portion of the main body and at a rear end portion thereof in a direction in which the main body is moved,
- the main body has a hanging structure for hanging a rope, and
- the hanging structure is provided in an area defined between the rolling part provided at the front end portion of the main body and the rolling part provided at the rear end portion of the main body.

7. The installation tool according to claim 1, wherein
- the holding structure is open at an upper portion thereof, and
- the pressing member has an abutting portion that, by being placed in a vicinity of a top of the feed line holder, abuts, from above, on the feed line which is to be introduced into the pressing member as the pressing member is moved.

8. The installation tool according to claim 7, further comprising a support part configured to move together with the main body along the rails and support the feed line which is to be introduced into the pressing member, the support part being disposed forward of the pressing member in a direction in which the main body is moved and being disposed at a position higher than the pressing member.

9. The installation tool according to claim 8, wherein the support part has a groove that guides the feed line.

10. The installation tool according to claim 1, further comprising a sub-pressing member configured to move together with the main body along the rails and continuously press a detection line into a sub-holding structure as the main body is moved, the sub-pressing member being disposed forward of the pressing member in a direction in which the main body is moved, the detection line being configured to detect an overheating state of the feed line, the sub-holding structure being configured to hold the detection line at a position where the detection line contacts the feed line in the feed line holder and being provided so as to be continuous with the holding structure.

11. The installation tool according to claim 10, wherein the main body has a hanging structure for hanging a rope at a position lower than a lower end of the sub-pressing member.

12. The installation tool according to claim 10, wherein
- the sub-pressing member has a leading end portion that moves within the holding structure and introduces the detection line into the sub-holding structure, and
- said installation tool further comprises a pressing support member configured to support the sub-pressing member in such a manner as to allow the leading end portion to move within the holding structure and to allow the sub-pressing member to be removed from the main body.

13. The installation tool according to claim 12, wherein
- the main body has a base body part that constitutes a basic structure of the main body, and
- the pressing support member has:
  - a mounting portion that is mounted to the base body part; and
  - a pair of protrusions that are disposed so as to cover the holding structure together with the mounting portion and to protrude above and below the feed line holder from the mounting portion,
- the pair of protrusions having respective inclined portions that are inclined such that an interval between the pair of protrusions decreases with increasing distance from introduction end portions which are provided on a side where the detection line is to be introduced to a rear side in a direction in which the main body is moved.

14. An installation method for installing a feed line in a feed line holder, the feed line holder accompanying rails for allowing a carrier to travel thereon and holding the feed line, the feed line feeding electric power to the carrier in a non-contact manner, the installation method comprising:

providing the installation tool of claim 1;

a fitting step of fitting, to the feed line holder having a holding structure which is partially open, the pressing member configured to press the feed line into the holding structure as the pressing member is moved; and a movement step of moving the pressing member along the rails.

15. The installation method according to claim 14, further comprising a mounting step of, prior to the movement step, placing, on the rails, the main body configured to be capable of moving along the rails and mounting, on the main body, the pressing member having been fitted to the feed line holder.

16. The installation method according to claim 14, further comprising a post-fitting step of fitting a sub-pressing member into a pressing support member, the sub-pressing member being configured to press a detection line into a sub-holding structure as the sub-pressing member is moved, the pressing support member being configured to support the sub-pressing member in such a manner as to allow the sub-pressing member to be removed from the main body configured to be capable of moving along the rails, the detection line being configured to detect an overheating state of the feed line, the sub-holding structure being configured to hold the detection line at a position where the detection line contacts the feed line in the feed line holder and being provided so as to be continuous with the holding structure, wherein in the movement step, the sub-pressing member is moved together with the pressing member.

17. The installation method according to claim 14, wherein, in the movement step, the pressing member is moved by pulling on a rope.

* * * * *